US012534682B2

(12) United States Patent
Kato et al.

(10) Patent No.: US 12,534,682 B2
(45) Date of Patent: Jan. 27, 2026

(54) VISCOSITY INDEX ENHANCER COMPOSITION, ADDITIVE COMPOSITION FOR LUBRICATING OIL, AND LUBRICATING OIL COMPOSITION

(71) Applicant: IDEMITSU KOSAN CO., LTD., Tokyo (JP)

(72) Inventors: Shota Kato, Chiyoda-ku (JP); Yukio Yoshida, Chiyoda-ku (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 18/720,902

(22) PCT Filed: Dec. 23, 2022

(86) PCT No.: PCT/JP2022/047698
§ 371 (c)(1),
(2) Date: Jun. 17, 2024

(87) PCT Pub. No.: WO2023/120716
PCT Pub. Date: Jun. 29, 2023

(65) Prior Publication Data

US 2025/0059459 A1 Feb. 20, 2025

(30) Foreign Application Priority Data

Dec. 24, 2021 (JP) ..... 2021-211631

(51) Int. Cl.

| | |
|---|---|
| ***C10M 169/04*** | (2006.01) |
| ***C10M 145/14*** | (2006.01) |
| ***C10M 155/04*** | (2006.01) |
| ***C10M 157/10*** | (2006.01) |
| *C10N 20/04* | (2006.01) |
| *C10N 30/02* | (2006.01) |

(52) U.S. Cl.
CPC ..... *C10M 169/041* (2013.01); *C10M 145/14* (2013.01); *C10M 155/04* (2013.01); *C10M 157/10* (2013.01); *C10M 2203/003* (2013.01); *C10M 2209/084* (2013.01); *C10M 2229/00* (2013.01); *C10N 2020/04* (2013.01); *C10N 2030/02* (2013.01)

(58) Field of Classification Search
CPC ..... C10M 169/041; C10M 145/14; C10M 155/04; C10M 157/10; C10M 2203/003; C10M 2209/084; C10M 2229/00; C10M 2203/1006; C10N 2020/04; C10N 2030/02
See application file for complete search history.

(56) References Cited

U.S. PATENT DOCUMENTS

| | | | | |
|---|---|---|---|---|
| 5,370,807 | A * | 12/1994 | Gambini | C10M 155/04 558/291 |
| 2017/0009176 | A1 | 1/2017 | Nguyen et al. | |
| 2019/0375930 | A1* | 12/2019 | Derouineau | C08L 35/06 |
| 2019/0382679 | A1* | 12/2019 | Derouineau | C10M 155/04 |
| 2020/0399412 | A1* | 12/2020 | Descroix | C08F 293/005 |
| 2020/0399415 | A1* | 12/2020 | Descroix | C08L 43/00 |
| 2021/0171878 | A1 | 6/2021 | Descroix et al. | |
| 2021/0198593 | A1* | 7/2021 | Descroix | C10M 169/041 |
| 2021/0214638 | A1* | 7/2021 | Descroix | C10M 169/04 |
| 2021/0309930 | A1* | 10/2021 | Descroix | C10M 145/14 |

FOREIGN PATENT DOCUMENTS

| | | | |
|---|---|---|---|
| JP | 2004-307551 | A | 11/2004 |
| JP | 2017-508055 | A | 3/2017 |
| JP | 2017-171882 | A | 9/2017 |
| JP | 2019-210470 | A | 12/2019 |
| JP | 2021-524521 | A | 9/2021 |

OTHER PUBLICATIONS

Combined International Search Report and Written Opinion dated Mar. 14, 2023 in corresponding International Application No. PCT/JP2022/047698 (with English translation), 13 pages.
Supplementary European Search Report issued Nov. 4, 2025, in European Patent Application No. 22911417.8 (6 pages).

* cited by examiner

*Primary Examiner* — Ellen M Mcavoy
(74) *Attorney, Agent, or Firm* — Oblon, McClelland, Maier & Neustadt, L.L.P.

(57) ABSTRACT

A viscosity index improver composition which has an excellent viscosity index improving effect. A viscosity index improver composition which includes a poly(meth)acrylate (A) including a constituent unit (Y) derived from a monomer (y) having a diol functional group, and a poly(meth)acrylate (B) including a constituent unit (Z) derived from a monomer (z) having a boronic acid ester.

20 Claims, No Drawings

VISCOSITY INDEX ENHANCER COMPOSITION, ADDITIVE COMPOSITION FOR LUBRICATING OIL, AND LUBRICATING OIL COMPOSITION

CROSS REFERENCE TO RELATED APPLICATIONS

This application is a National Stage entry under 35 U.S.C. § 371 of PCT/JP2022/047698, filed on Dec. 23, 2022, and claims priority to JP Patent Application No. 2021-211631, filed on Dec. 24, 2021, the entire contents of which are incorporated herein by reference.

TECHNICAL FIELD

The present invention relates to a viscosity index improver composition, an additive composition for lubricating oil, and a lubricating oil composition.

BACKGROUND ART

In recent years, lubricating oil compositions used as drive system oils such as automatic transmission fluid (ATF), continuously variable transmission fluid (CVTF), and shock absorber oil (SAF), internal combustion engine oil, and equipment oils such as hydraulic fluid, are required to have various properties depending on each application.

For example, with regard to increasing the fuel efficiency of automobiles, in addition to improvements of the automobile itself such as reducing the weight of the automobile and improving the engine, improvements of lubricating oils such as reducing viscous resistance by lowering the viscosity of the lubricating oil composition and adding various lubricating oil additives, have been also important. However, since lubricating oil compositions are used over a wide temperature range, when simply reducing the viscosity, an oil film on lubricated part will become thin under high temperature conditions, and this will become a cause of occurring the problems such as increasing of wear and seizure due to contact between members. Therefore, it is desirable that the viscosity of the lubricating oil composition does not change as much as possible over a wide temperature range. That is, it is desirable that the lubricating oil composition has a high viscosity index.

Therefore, in lubricating oil compositions used in a wider temperature range from high temperatures to low temperatures, a method which improves the temperature dependence of viscosity by adding a viscosity index improver is generally used.

For example, Patent Literature 1 describes a lubricating oil composition containing a composition (viscosity index improver composition) in which a copolymer containing a diol group and a compound containing a boronic acid ester functional group are mixed.

CITATION LIST

Patent Literature

PTL1: JP2017-508055A

SUMMARY OF INVENTION

Technical Problem

However, the composition (viscosity index improver composition) described in Patent Literature 1 cannot be said to have a sufficient viscosity index improving effect, and there is room for further improvement.

Therefore, the object of the present invention is to provide a viscosity index improver composition having an excellent viscosity index improving effect, an additive composition for lubricating oil containing the viscosity index improver composition, a lubricating oil composition containing the viscosity index improver composition, and a method for producing the lubricating oil composition.

Solution to Problem

According to the present invention, the following items [1] to [4] are provided.

[1]A viscosity index improver composition containing:
- the following poly(meth)acrylate (A); and
- the following poly(meth)acrylate (B),
- and satisfying the following requirement (1) or (2),
  - Poly(meth)acrylate (A): containing a constituent unit (Y) derived from a monomer (y) having a diol functional group,
  - Poly(meth)acrylate (B): containing a constituent unit (Z) derived from a monomer (z) having a boronic acid ester,
  - Requirement (1): Both of the poly(meth)acrylate (A) and the poly(meth)acrylate (B) contain a constituent unit (X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain, and both of the poly(meth)acrylate (A) and the poly(meth)acrylate (B) may further contain a constituent unit (X2) derived from (meth)acrylate (x2) having a linear or branched alkyl group which has 10 to 23 carbon atoms in the side chain,
  - Requirement (2): One of the poly(meth)acrylate (A) and the poly(meth)acrylate (B) contains a constituent unit (X1) derived from (meth)acrylate (x1) having a linear alkyl group which has 4 or less of carbon atoms in the side chain, and a constituent unit (X3) derived from (meth)acrylate (x3) having a branched alkyl group which has 24 to 38 of carbon atoms in the side chain, and at least the other of the poly (meth)acrylate (A) and the poly(meth)acrylate (B) contains a constituent unit (X2) derived from (meth) acrylate(x2) having a linear or branched alkyl group which has 10 to 23 carbon atoms in the side chain.

[2] An additive composition for lubricating oil containing the viscosity index improver composition according to the above item [1].

[3]A lubricating oil composition containing:
- the viscosity index improver composition according to the above item [1]; and
- a lubricating base oil.

[4]A method for producing a lubricating oil composition containing:
- a step of mixing a lubricating base oil and the following poly(meth)acrylate (A) and the following poly(meth) acrylate (B),
- and satisfying the following requirement (1) or (2),
  - Poly(meth)acrylate (A): containing a constituent unit (Y) derived from a monomer (y) having a diol functional group,
  - Poly(meth)acrylate (B): containing a constituent unit (Z) derived from a monomer (z) having a boronic acid ester, Requirement (1): Both of the poly(meth)acrylate (A) and the poly(meth)acrylate (B) contain a constituent unit (X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain, and both of the poly(meth)acrylate (A) and the poly(meth)acrylate (B) may further contain a constituent unit (X2) derived from (meth)acrylate (x2) having a linear or branched alkyl group which has 10 to 23 carbon atoms in the side chain, Requirement (2): One of the poly(meth)acrylate (A) and the poly(meth)acrylate (B) contains a constituent unit (X1) derived from (meth)acrylate (x1) having a linear alkyl group which has 4 or less of carbon atoms in the side chain, and a constituent unit (X3) derived from (meth)acrylate (x3) having a branched alkyl group which has 24 to 38 of carbon atoms in the side chain, and at least the other of the poly (meth)acrylate (A) and the poly(meth)acrylate (B) contains a constituent unit (X2) derived from (meth) acrylate(x2) having a linear or branched alkyl group which has 10 to 23 carbon atoms in the side chain.

Advantageous Effects of Invention

According to the present invention, it is possible to provide a viscosity index improver composition having an excellent viscosity index improving effect, an additive composition for lubricating oil containing the viscosity index improver composition, a lubricating oil composition containing the viscosity index improver composition, and a method for producing the lubricating oil composition.

DESCRIPTION OF EMBODIMENTS

Upper limit values and lower limit values of numerical ranges described in this description can be arbitrarily combined. For example, when "A to B" and "C to D" are described as numerical ranges, the numerical ranges of "A to D" and "C to B" are also included in the scope of the present invention.

In addition, the numerical range "lower limit value to upper limit value" described in this description means the lower limit value or more, and the upper limit value or less, unless otherwise specified.

In addition, in this description, numerical values in Examples are the numerical values that can be used as the upper limit value or lower limit value.

In this description, "(meth)acrylate" means acrylate or methacrylate, and the same meanings are applied to similar terms. For example, "poly(meth)acrylate" means polyacrylate or polymethacrylate.

[Embodiments of Viscosity Index Improver Composition]

A viscosity index improver composition of the embodiment contains the following poly(meth)acrylate (A); and the following poly(meth)acrylate (B), and satisfies the following requirement (1) or (2).

Poly(meth)acrylate (A): containing a constituent unit (Y) derived from a monomer (y) having a diol functional group, Poly(meth)acrylate (B): containing a constituent unit (Z) derived from a monomer (z) having a boronic acid ester, Requirement (1): Both of the poly(meth)acrylate (A) and the poly(meth)acrylate (B) contain a constituent unit (X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain, and both of the poly(meth)acrylate (A) and the poly(meth)acrylate (B) may further contain a constituent unit (X2) derived from (meth)acrylate (x2) having a linear or branched alkyl group which has 10 to 23 carbon atoms in the side chain, Requirement (2): One of the poly(meth)acrylate (A) and the poly(meth)acrylate (B) contains a constituent unit (X1) derived from (meth)acrylate (x1) having a linear alkyl group which has 4 or less of carbon atoms in the side chain, and a constituent unit (X3) derived from (meth)acrylate (x3) having a branched alkyl group which has 24 to 38 of carbon atoms in the side chain, and at least the other of the poly(meth)acrylate (A) and the poly(meth)acrylate (B) contains a constituent unit (X2) derived from (meth)acrylate(x2) having a linear or branched alkyl group which has 10 to 23 carbon atoms in the side chain.

Note that when the viscosity index improver composition of the present embodiment satisfies the requirement (1), the constituent unit (X1) contained in each of the poly(meth) acrylate (A) and the poly(meth)acrylate (B) may be same or different.

Note that when the viscosity index improver composition of the present embodiment satisfies the requirement (1), the constituent unit (X3) contained in each of the poly(meth) acrylate (A) and the poly(meth)acrylate (B) may be same or different.

Furthermore, in the viscosity index improver composition of the embodiment, when the constituent unit (X2) is contained in both of the poly(meth)acrylate (A) and the poly (meth)acrylate (B), these may be the same or different.

The present inventors have conducted intensive studies to solve the above problems. As a result, it was found that a viscosity index improver composition containing the poly (meth)acrylate (A) and the poly(meth)acrylate (B), and satisfying the following requirement (1) or (2), can have the excellent viscosity index improving effect.

The reason why the viscosity index improver composition of the embodiment is excellent in the viscosity index improving effect is presumed to be as follows (i) to (iii).

(i) When a viscosity index improver composition containing the poly(meth)acrylate (A) and the poly(meth)acrylate (B) and satisfying the requirement (1) and the requirement (2) is blended in the lubricating base oil, the viscosity of the lubricating oil composition is difficult to increase at low temperatures, since the poly(meth)acrylate (A) and the poly(meth)acrylate (B) are difficult to react at low temperatures and easily maintain their separate and independent state. On the other hand, at high temperatures, the boronic acid ester bond present in the side chains of the poly(meth) acrylate (B) undergoes a transesterification reaction with the diol group present in the side chain of the poly(meth) acrylate (A). Therefore, at high temperatures, the poly(meth) acrylate (B) and the poly(meth)acrylate (A) tend to be in an associated state, which tends to occur the action of increasing the viscosity of the lubricating oil composition at high temperatures.

(ii) Poly(meth)acrylate containing the constituent unit (X1) tends to shrink at low temperatures. Therefore, it tends to keep the viscosity of the lubricating oil composition low at low temperatures. When the requirement (1) and the requirement (2) are satisfied, the action of keeping the viscosity of the lubricating oil composition low at low temperatures occurs, since one or both of the poly(meth) acrylate (A) and the poly(meth)acrylate (B) contain the constituent unit (X1).

(iii) By combining the "action of increasing the viscosity of the lubricating oil composition at high temperatures" by the above item (i) and the "action of keeping the viscosity of the lubricating oil composition low at low temperatures" by the above item (ii), an excellent viscosity index improving effect is exhibited.

Note that in the following description, "poly(meth)acrylate" may be abbreviated as "PMA".

Hereinafter, each constituent unit that PMA (A) and PMA (B) contain or may contain will be explained in detail, and then PMA (A) and PMA (B) will be explained in detail.

(Constituent Unit (X1))

The constituent unit (X1) is a constituent unit derived from (meth)acrylate (x1) having a linear alkyl group which has 4 or less carbon atoms in the side chain.

When the viscosity index improver composition of the embodiment satisfies the requirement (1), the constituent unit (X1) is contained in both of PMA (A) and PMA(B). When the viscosity index improver composition of the embodiment satisfies the requirement (2), the constituent unit (X1) is contained in one of PMA (A) and PMA(B).

PMA containing the constituent unit (X1) tends to shrink at low temperatures. Therefore, when one or both of PMA (A) and PMA (B) contains the constituent unit (X1), a viscosity index improver composition having an excellent viscosity index improving effect can be obtained.

When both of PMA (A) and PMA (B) do not contain the constituent unit (X1), the viscosity index improving effect will not be sufficiently exhibited.

Note that, from the viewpoint of making it easier to increase the viscosity index improving effect, it is preferable that the constituent unit (X1) is contained in both of PMA (A) and PMA (B) as defined by requirement (1).

When the viscosity index improver composition of the embodiment satisfies the requirement (2), from the viewpoint of making it easier to increase the viscosity index improving effect, it is preferable that the constituent unit (X1) is contained in PMA (A).

Note that the alkyl group contained in the (meth)acrylate (x1) is preferably a methyl group or an ethyl group, and more preferably a methyl group, from the viewpoint of making it easier to increase the viscosity index improving effect.

Examples of the (meth)acrylate (x1) (hereinafter also referred to as "monomer (x1)") having a linear alkyl group which has 4 or less carbon atoms in the side chain preferably include (meth)acrylate represented by the following general formula (I-1).

(I-1)

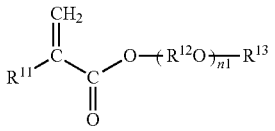

[in the general formula (I-1), $R^{11}$ represents a hydrogen atom or a methyl group, $R^{12}$ represents a linear or branched alkylene group having 2 to 4 carbon atoms, and $R^{13}$ represents a linear alkyl group having less than 4 carbon atoms. n1 represents an integer of 0 to 20. When n1 is 2 or more, a plurality of $R^{12}$'s may be the same or different.]

Preferred embodiments indicated by each symbol in general formula (I-1) are shown below.

$R^{11}$ is preferably a methyl group, from the viewpoint of making it easier to increase the viscosity index improving effect.

Examples of linear or branched alkylene groups having 2 to 4 carbon atoms which can be selected as $R^{12}$ include an ethylene group, a propane-1,2-diyl group, a propane-1,3-diyl group, a butane-1,2-diyl group, a butane-1,3-diyl group, a butane-1,4-diyl group, and a butane-2,2-diyl group, and among these, an ethylene group and a propane-1,2-diyl group are preferred.

Examples of the alkyl group having 4 or less carbon atoms which can be selected as $R^{13}$, include a methyl group, an ethyl group, an n-propyl group, and a n-butyl group. Among these, a methyl group or an ethyl group are preferred, and a methyl group is more preferred, from the viewpoint of making it easier to increase the viscosity index improving effect.

n1 is preferably an integer of 0 to 5, more preferably an integer of 0 to 2, even more preferably 0, from the viewpoint of solubility in base oil of PMA (A) and PMA (B) which contain or may contain the constituent unit (X1).

When n1 is 2 or more, a plurality of $R^{12}$'s may be the same or different. Furthermore, the embodiment of bonding between the moieties represented by $—(R^{12}O—)_{n1}$ in general formula (1) may be random bonding or block bonding.

Specific examples of (meth)acrylate represented by general formula (I-1) include methyl (meth)acrylate, ethyl (meth)acrylate, n-propyl (meth)acrylate, and n-butyl (meth) acrylate. Among these, methyl(meth)acrylate and ethyl (meth)acrylate are preferred, methyl(meth)acrylate is more preferred, and methyl methacrylate is even more preferred.

Note that the monomer (x1) may be used alone, or may be used in combination of two or more thereof.

(Constituent Unit (X2))

The constituent unit (X2) is a constituent unit derived from (meth)acrylate (x2) having a linear alkyl group which has 10 to 23 carbon atoms in the side chain.

When the viscosity index improver composition of the embodiment satisfies the requirement (1), the constituent unit (X2) may be contained in one of or both of PMA (A) and PMA(B). When the viscosity index improver composition of the embodiment satisfies the requirement (2), the constituent unit (X2) is contained in at least one of the PMA (A) and the PMA(B). Namely, among PMA (A) and PMA (B), the constituent unit (X2) is contained in the PMA which does not contain the constituent unit (X1) and the constituent unit (X3). Further, among PMA (A) and PMA (B), the constituent unit (X2) may be contained in the PMA which contains the constituent unit (X1) and the constituent unit (X3).

Note that when the viscosity index improver composition of the embodiment satisfies the requirement (2), the solubility of the PMA (A) and the PMA (B) in the base oil of the other PMA cannot be ensured without the constituent unit (X2) being contained in at least one of the PMA (A) and the PMA (B).

The PMA containing the constituent unit (X2) tends to have excellent solubility in base oil. Therefore, when the PMA (A) contains the constituent unit (X2), it becomes easy to improve the solubility of the PMA (A) in base oils. Therefore, when the PMA (B) contains the constituent unit (X2), it becomes easy to improve the solubility of the PMA (B) in base oils.

Note that it is preferable that both of the PMA (A) and the PMA (B) contain the constituent unit (X2), from the viewpoint of making it easier to improve the solubility of the viscosity index improver composition of the embodiment in base oil.

Further, when both of the PMA (A) and the PMA (B) contain the constituent unit (X2), the constituent units (X2) contained in each of PMA (A) and PMA (B) may be the same, or different.

The number of carbon atoms in the linear or branched alkyl group of the constituent unit (X2) is preferably 10 to 20, more preferably 12 to 18, from the viewpoint of making it easier to improve the solubility of the viscosity index improver composition of the embodiment in the base oil, and from the viewpoint of making it easier to exhibit the effect of the present invention.

Examples of the (meth)acrylate (x2) (hereinafter also referred to as "monomer (x2)") having a linear or branched alkyl group which has 10 to 23 carbon atoms in the side chain preferably include (meth)acrylates represented by the following general formula (I-2).

(I-2)

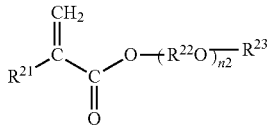

[In the general formula (I-2), $R^{21}$ represents a hydrogen atom or a methyl group, $R^{22}$ represents a linear or branched alkylene group having 2 to 4 carbon atoms, and $R^{23}$ represents a linear or branched alkyl group having 10 to 23 carbon atoms. n2 represents an integer of 0 to 20. When n2 is 2 or more, a plurality of $R^{22}$'s may be the same or different.]

Preferred embodiments indicated by each symbol in general formula (I-2) are shown below.

$R^{21}$ is preferably a methyl group, from the viewpoint of making it easier to increase the viscosity index improving effect.

Examples of the linear or branched alkylene group having 2 to 4 carbon atoms which can be selected as $R^{22}$ include the same groups as those listed for $R^{12}$, and the preferred embodiments are also the same as those for $R^{12}$.

Examples of the linear or branched alkyl group having 10 to 23 carbon atoms which can be selected as $R^{23}$ include a decyl group, an undecyl group, a dodecyl group, a tridecyl group, a tetradecyl group, a pentadecyl group, a hexadecyl group, a heptadecyl group, an octadecyl group, a nonadecyl group, an icosyl group, a heneicosyl group, a docosyl group, and a tricosyl group. When $R^{23}$ is a branched alkyl group, the branching position is not particularly limited.

Note that the alkyl group which can be selected as $R^{23}$ preferably has 10 to 20 carbon atoms, more preferably 12 to 18 carbon atoms.

n2 is preferably an integer of 0 to 5, more preferably an integer of 0 to 2, even more preferably 0, from the viewpoint of solubility in base oil of PMA (A) and PMA (B) which contain the constituent unit (X2).

When n2 is 2 or more, a plurality of $R^{22}$'s may be the same or different. Furthermore, the embodiment of bonding between the moieties represented by $—(R^{22}O—)_{n2}$ in general formula (I-2) may be random bonding or block bonding.

Specific examples of (meth)acrylates represented by general formula (1-2) include n-decyl (meth)acrylate, n-undecyl (meth)acrylate, n-dodecyl (meth)acrylate, and n-tridecyl (meth)acrylate, n-tetradecyl (meth)acrylate, n-pentadecyl (meth)acrylate, n-hexadecyl (meth)acrylate, n-heptadecyl (meth)acrylate, n-octadecyl (meth)acrylate, n-nonadecyl (meth)acrylate, n-icosyl (meth)acrylate, n-henicosyl (meth)acrylate, n-docosyl (meth)acrylate, n-tricosyl (meth)acrylate, isostearyl (meth)acrylate, and the like. Among these, n-decyl (meth)acrylate, n-undecyl (meth)acrylate, n-dodecyl (meth)acrylate, n-tridecyl (meth)acrylate, n-tetradecyl (meth)acrylate, n-pentadecyl (meth)acrylate, n-hexadecyl (meth)acrylate, n-heptadecyl (meth)acrylate, n-octadecyl (meth)acrylate, n-nonadecyl (meth)acrylate, and n-icosyl (meth)acrylate are preferred, and n-dodecyl (meth)acrylate, n-tridecyl (meth)acrylate, n-tetradecyl (meth)acrylate, n-pentadecyl (meth)acrylate, n-hexadecyl (meth)acrylate, n-heptadecyl (meth)acrylate, and n-octadecyl (meth)acrylate are more preferred, and n-dodecyl (meth)acrylate is even more preferred.

Note that the monomer (x2) may be used alone or may be used in combination of two or more thereof.

(Constituent Unit (X3))

The constituent unit (X3) is a constituent unit derived from (meth)acrylate (x3) having a branched alkyl group which has 24 to 38 carbon atoms in the side chain.

When the viscosity index improver composition of the embodiment satisfies the requirement (1), the constituent unit (X3) is contained in both of PMA (A) and PMA(B). When the viscosity index improver composition of the embodiment satisfies the requirement (2), the constituent unit (X3) is contained in the PMA which contains the constituent unit (X1), among PMA (A) and PMA (B).

The PMA containing the constituent unit (X1) has reduced solubility in base oil. Therefore, by making the viscosity index improver composition of the embodiment include the constituent unit (X3) in PMA together with the constituent unit (X1), the solubility of PMA in the base oil is ensured.

Here, it is preferable that the constituent unit (X1) is contained in both of the PMA (A) and the PMA (B), from the viewpoint of making it easier to improve the viscosity index improving effect of the viscosity index improver composition of the embodiment. Therefore, it is preferable that the constituent unit (X3) is also contained in both of the PMA (A) and the PMA(B).

Further, as described above, when the viscosity index improver composition of the embodiment satisfies the requirement (2), it is preferable that the constituent unit (X1) is contained in the PMA (A), from the viewpoint of making it easier to improve the viscosity index improving effect. Therefore, it is preferable that the constituent unit (X3) is also contained in the PMA (A).

The number of carbon atoms in the branched alkyl group of the constituent unit (X3) is preferably 24 to 32, more preferably 28 to 32, even more preferably 32, from the viewpoint of making it easier to further improve the viscosity index improving effect of the viscosity index improver composition of the embodiment.

Examples of the (meth)acrylate (x3) (hereinafter also referred to as "monomer (x3)") having a branched alkyl group which has 24 to 38 carbon atoms in the side chain preferably include (meth)acrylate represented by the following general formula (I-3).

(I-3)

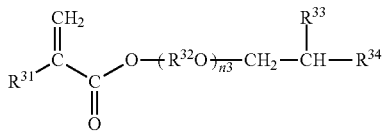

[In the general formula (I-3), $R^{31}$ represents a hydrogen atom or a methyl group, $R^{32}$ represents a linear or branched alkylene group having 2 to 4 carbon atoms, and $R^{33}$ and $R^{34}$ each independently represent a linear or branched alkyl group. Total carbon number of the alkyl groups which can be selected as $R^{33}$ and $R^{34}$ is 22 to 36. n3 represents a integer of 0 to 20. When n3 is 2 or more, a plurality of $R^{32}$'s may be the same or different.]

Preferred embodiments indicated by each symbol in general formula (I-3) are shown below.

$R^{31}$ preferably represents a methyl group, from the viewpoint of making it easier to increase the viscosity index improving effect.

Examples of the linear or branched alkylene group having 2 to 4 carbon atoms which can be selected as $R^{32}$ include the same groups as those listed for $R^{12}$, and the preferred embodiments are also the same as those for $R^{12}$.

n3 is preferably an integer of 0 to 5, more preferably an integer of 0 to 2, even more preferably 0, from the viewpoint of solubility in base oil of PMA (A) and PMA (B) which contain or may contain the constituent unit (X3).

When n3 is 2 or more, a plurality of $R^{32}$'s may be the same or different. Furthermore, the embodiment of bonding between the moieties represented by $—(R^{32}O—)_{n3}$ in general formula (1) may be random bonding or block bonding.

The total carbon number of the alkyl group and alkenyl group that can be selected as $R^{33}$ and $R^{34}$ is preferably 22 to 30, more preferably 26 to 30, and even more preferably 30.

Further, the alkyl group which can be selected as $R^{33}$ and $R^{34}$ may be either a linear or a branched alkyl group, but preferably a linear alkyl group.

$R^{33}$ and $R^{34}$ may be the same or different, but are preferably different.

Further, as one example of the preferred embodiments of the (meth)acrylate represented by the general formula (I-3), for example, when $R^{33}$ and $R^{34}$ are different from each other, for example, $R^{33}$ is preferably an alkyl group having 10 to 18 carbon atoms, more preferably an alkyl group having 12 to 16 carbon atoms. $R^{34}$ preferably represents an alkyl group having 12 to 18 carbon atoms, more preferably an alkyl group having 14 to 18 carbon atoms.

Specific examples of the (meth)acrylate represented by general formula (I-3) include 2-hexyldecyl methacrylate, 2-decyltetradecyl methacrylate, 2-dodecylhexadecyl methacrylate, and 2-tetradecyl octadecyl methacrylate. Among these, 2-decyltetradecyl methacrylate, 2-dodecylhexadecyl methacrylate, or 2-tetradecyl octadecyl methacrylate are preferred, 2-decyltetradecyl methacrylate or 2-tetradecyl octadecyl methacrylate is more preferred, and 2-tetradecyl octadecyl methacrylate is even more preferred.

Note that the monomer (x3) may be used alone or may be used in combination of two or more thereof.

(Constituent Unit (Y))

The constituent unit (Y) is a constituent unit derived from the monomer (y) having a diol functional group, and contained in the PMA (A).

Examples of the monomer (y) having a diol functional group preferably include a compound represented by the following general formula (II).

(II)

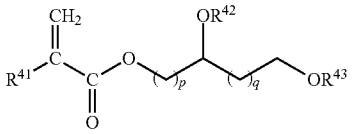

In the general formula (IT), $R^{41}$ represents a hydrogen atom or a methyl group. A methyl group is preferred.

p represents a integer of 2 to 18.

p is preferably 3 to 8, more preferably 4.

q is 0 or 1.

q is preferably 0.

$R^{42}$ and $R^{43}$ each independently represent a hydrogen atom, a tetrahydropyranyl group, a methyloxymethyl group, a tert-butyl group, a benzyl group, a trimethylsilyl group, or a tert-butyldimethylsilyl group.

Alternatively, $R^{42}$ and $R^{43}$ may form a bridge represented by the following general formula (IIa) together with an oxygen atom.

(IIa)

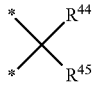

In the general formula (IIa), * is a bonding position with the oxygen atom. $R^{44}$ and $R^{45}$ each independently represent a hydrogen atom or an alkyl group having 1 to 11 carbon atoms.

Note that when $R^{44}$ and $R^{45}$ are an alkyl group having 1 to 11 carbon atoms, the alkyl group may be linear or branched, however it is preferably linear alkyl groups. Specifically, the linear alkyl group is preferably a methyl group, an ethyl group, a n-propyl group, a n-butyl group, a n-pentyl group, a n-hexyl group, a n-heptyl group, a n-octyl group, a n-nonyl group, a n-decyl group, or a n-undecyl group. A methyl group is more preferred.

Alternatively, $R^{42}$ and $R^{43}$ may form a boronic acid ester represented by the following general formula (IIb) with an oxygen atom.

(IIb)

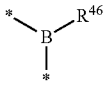

In the general formula (IIb), * is a bonding position with the oxygen atom. $R^{46}$ is an aryl group having 6 to 18 carbon atoms, an aralkyl group having 7 to 18 carbon atoms, or an alkyl group having 2 to 18 carbon atoms.

Note that "an aryl group having 6 to 18 carbon atoms" may be monocyclic or polycyclic. Examples of the aryl group having 6 to 18 carbon atoms include a phenyl group, a naphthyl group, an anthracenyl group, a phenanthrenyl group, and a tetracenyl group.

Furthermore, "an aralkyl group having 7 to 18 carbon atoms" is a group in which at least one hydrogen atom of an aryl group is substituted with a linear or branched alkyl group, and means a group in which the total number of carbon atoms of the aryl group and the alkyl group is 7 to 18. Examples of the aralkyl group having 7 to 18 carbon atoms include a benzyl group, a tolyl group, and a xylyl group.

Further, "an alkyl group having 2 to 18 carbon atoms" may be linear or branched.

Among the above, $R^{46}$ is preferably an aryl group having 6 to 18 carbon atoms, and more preferably a phenyl group.

Note that when $R^{46}$ is an alkyl group having 2 to 18 carbon atoms, the alkyl group is preferably a linear alkyl group.

Among the monomers represented by the above general formula (II), preferred embodiments include monomers represented by the following general formula (II-A).

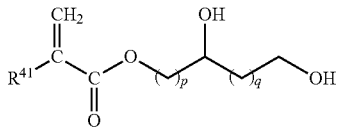

(II-A)

In the general formula (II-A), $R^{41}$, p, and q are as explained in the above general formula (II), and their preferred ranges are also as explained in the above general formula (II).

Further, among the monomers represented by the above general formula (II), other preferred embodiments include monomers represented by the following general formula (II-B).

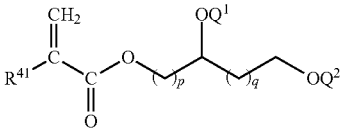

(II-B)

In the general formula (II-A), $R^{41}$, p, and q are as explained in the above general formula (II), and their preferred ranges are also as explained in the above general formula (II).

$Q^1$ and $Q^2$ each independently represent a tetrahydropyranyl group, a methyloxymethyl group, a tert-butyl group, a benzyl group, a trimethylsilyl group, or a tert-butyldimethylsilyl group.

Alternatively, $Q^1$ and $Q^2$ form a bridge represented by the above general formula (IIa) with an oxygen atom.

Alternatively, $Q^1$ and $Q^2$ form a boronic acid ester represented by the above general formula (IIb) with an oxygen atom.

Note that the monomer (y) may be used alone or may be used in combination of two or more thereof.

Further, from the viewpoint of the effects of the present invention, the monomer (y) preferably contains a monomer represented by the above general formula (II-A) (that is, a monomer having a diol group). The content of the monomer represented by the above general formula (II-A) is preferably 50 mol % to 100 mol %, more preferably 60 mol % to 100 mol %, even more preferably 70 mol % to 100 mol %, further more preferably 80 mol % to 100 mol %, even further preferably 90 mol % to 100 mol %, based on the total amount of monomer (y) (100 mol %).

(Preparation of Monomer (y) Having Diol Functional Group)

The monomer represented by the above general formula (II-A) (a monomer having a diol group) is obtained by deprotection of —$OQ^1$ and —$OQ^2$ of the monomer represented by the above general formula (II-B) by the following reaction formula (1).

[Reaction formula 1]

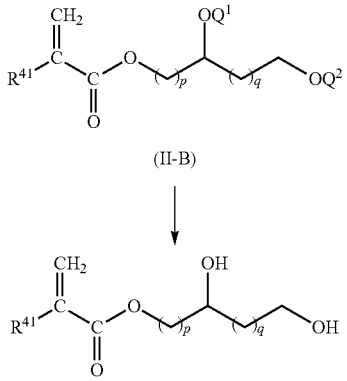

(II-B)

(II-A)

The deprotection reaction of —$OQ^1$ and —$OQ^2$ of the monomer represented by the above general formula (II-B) can be carried out by appropriately selecting reaction conditions depending on the properties of the protecting groups $Q^1$ and $Q^2$.

The monomer represented by the above general formula (II-B) can be obtained by the reaction (reaction formula 2) between the alcohol compound of the following general formula (II-b) and the compound represented by the following general formula (II-c).

[Reaction formula 2]

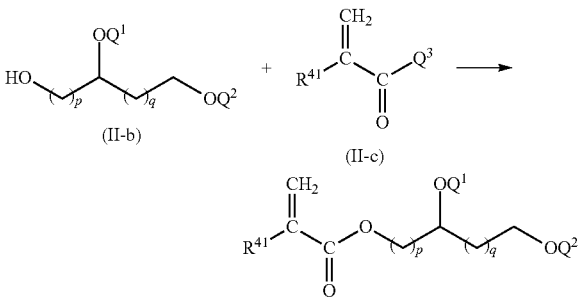

(II-b)

(II-c)

(II-B)

$R^{41}$, p, and q in the above general formula (II-b) and the above general formula (II-c) are as explained in the above general formula (II), and their preferred ranges are also as explained in the above general formula (II).

$Q^1$ and $Q^2$ in the above general formula (II-b) are as explained in the above general formula (II-b).

In the above general formula (II-c), $Q^3$ is a halogen atom (chlorine, bromine, fluorine, and iodine), preferably chlorine.

The compounds of the above general formula (II-c) are available from suppliers such as Sigma-Aldrich (registered trademark) and Alfa Aesar (registered trademark).

The alcohol compound of the above general formula (II-b) can be obtained from the above general formula (II-a) by protection of the diol group by the following reaction formula 3.

[Reaction formula 3]

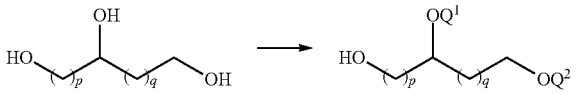

(II-a) (II-b)

The deprotection reaction of the monomer represented by the above general formula (II-a) can be carried out by appropriately selecting reaction conditions depending on the properties of the protecting groups $Q^1$ and $Q^2$.

The compounds of the above general formula (II-a) are available from suppliers such as Sigma-Aldrich (registered trademark) and Alfa Aesar (registered trademark).

(Constituent Unit (Z))

The constituent unit (Z) is a constituent unit derived from the monomer (z) having a boronic acid ester, and contained in the PMA(B).

Examples of the monomer (z) having a boronic acid ester preferably include a compound represented by the following general formula (III).

(III)

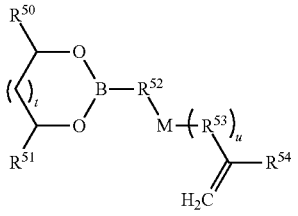

In the general formula (III), t represents 0 or 1.

t is preferably 0.

u represents 0 or 1.

u is preferably 1.

$R^{50}$ and $R^{51}$ each independently represent a hydrogen atom or a hydrocarbon-containing chain having 1 to 24 carbon atoms.

A "hydrocarbon-containing chain having 1 to 24 carbon atoms" refers to a linear or branched chain alkyl group having 1 to 24 carbon atoms, or a linear or branched chain alkenyl group having 1 to 24 carbon atoms. The number of carbon atoms in the hydrocarbon-containing chain is preferably 4 to 18, more preferably 6 to 12.

$R^{50}$ and $R^{51}$ may be the same or different.

$R^{52}$ and $R^{53}$ each independently represent an arylene group having 6 to 18 carbon atoms, an aralkylene group having 7 to 24 carbon atoms, and an alkylene group having 2 to 24 carbon atoms.

"An arylene group having 6 to 18 carbon atoms" may be monocyclic or polycyclic. Examples of the arylene group having 6 to 18 carbon atoms include a phenylene group, a naphthylene group, an anthracenylene group, a phenanthrenylene group, and a tetracenylene group.

"An aralkylene group having 7 to 24 carbon atoms" is a divalent group in which one hydrogen atom is removed from an aralkyl group having 7 to 24 carbon atoms. Examples of the aralkylene group having 7 to 24 carbon atoms include a divalent group in which one hydrogen atom is removed from a benzyl group, a divalent group in which one hydrogen atom is removed from a tolyl group, and a divalent group in which one hydrogen atom is removed from a xylyl group.

"An alkylene group having 2 to 24 carbon atoms" may be linear or branched. The alkylene group preferably has 6 to 16 carbon atoms.

$R^{52}$ is preferably an arylene group having 6 to 18 carbon atoms, more preferably a phenylene group. $R^{53}$ is preferably an aralkylene group having 7 to 24 carbon atoms, and more preferably a divalent group in which one hydrogen atom is removed from a benzyl group.

$R^{52}$ and $R^{53}$ may be the same or different.

M represents —O—C(O)—, —C(O)—O—, —C(O)—N(H)—, —N(H)—C(O)—, —S—, —N(H)—, —N($R^a$)—, or —O—. Note that $R^a$ is a hydrocarbon-containing chain having 1 to 15 carbon atoms.

A "hydrocarbon-containing chain having 1 to 15 carbon atoms" refers to a linear or branched chain alkyl group having 1 to 15 carbon atoms, or a linear or branched chain alkenyl group having 1 to 15 carbon atoms. A linear alkyl group is preferred. In addition, the number of carbon atoms is preferably 1 to 8.

M is preferably —C(O)—O—.

$R^{54}$ represents a hydrogen atom or a methyl group.

$R^{54}$ is preferably a methyl group.

Note that the monomer (z) may be used alone or may be used in combination of two or more thereof.

(Preparation of Monomer (z) Having a Boronic Acid Ester)

The monomer (z) having a boronic acid ester can be obtained, for example, by a preparation step including at least one step of condensation of a compound of the following general formula (III-a) and a compound of the following general formula (III-b) by the following reaction formula 4.

[Reaction formula 4]

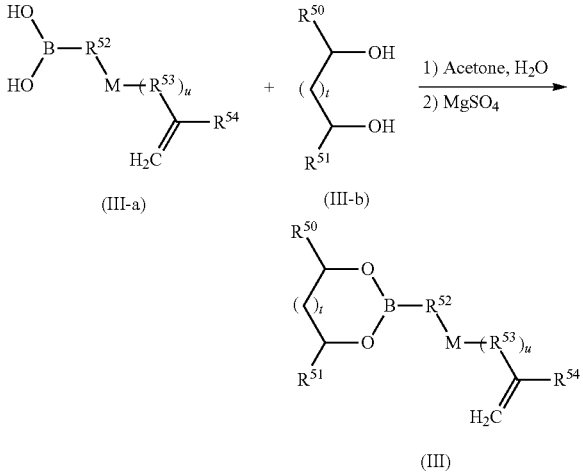

(III-a) (III-b)

(III)

$R^{50}$, $R^{51}$, $R^{52}$, $R^{53}$, $R^{54}$, M, t, and u in the above general formula (III-a), the above general formula (III-b), and the above general formula (III) are as explained in the above general formula (III), and their preferred ranges are also as explained in the above general formula (III).

The monomer (z) of general formula (III) is obtained by condensation of the boronic acid group in the compound of general formula (III-a) with the diol group in the compound of general formula (III-b). This step is carried out by methods well known to those skilled in the art.

Note that the compound of the above general formula (III-a) is dissolved in a polar solvent such as acetone in the presence of water. The condensation reaction is carried out in the presence of a dehydrating agent such as magnesium sulfate.

The compounds of the above general formula (III-b) are available from suppliers such as Sigma-Aldrich (registered trademark), Alfa Aesar (registered trademark), and TCI (registered trademark).

The compound of the above general formula (III-a) can be obtained directly from the compound of the following general formula (III-a1) by hydrolysis of the reaction formula 5.

[Reaction formula 5]

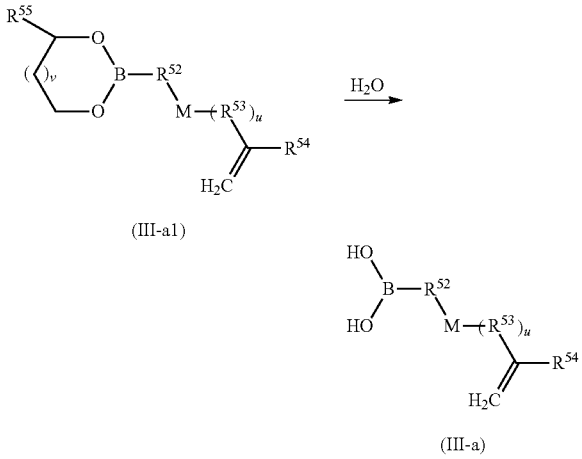

In the general formula (III-a1), v is 0 or 1.

$R^{55}$ is a hydrogen atom, a methyl group, or an ethyl group.

$R^{52}$, $R^{53}$, $R^{54}$, M, and u are as explained in the above general formula (III), and their preferred ranges are also as explained in the above general formula (III).

The compound of the above general formula (III-a1) can be obtained by a condensation reaction of a compound of the following general formula (III-a11) and a compound of the following general formula (III-a12) by the following reaction formula 6.

[Reaction formula 6]

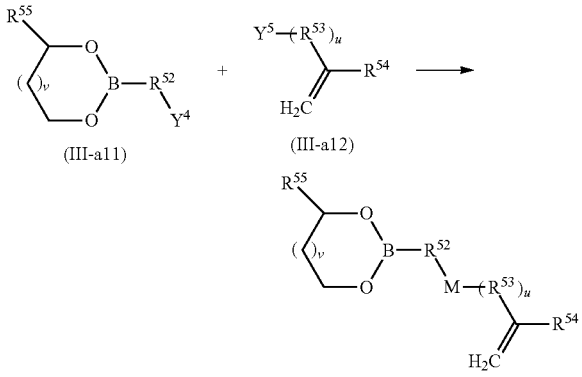

$R^{52}$, $R^{53}$, $R^{54}$, $R^{55}$, and u in the above general formula (III-a11), the above general formula (III-a12), and the above general formula (III-a1) are as explained in the above general formula (III), and their preferred ranges are also as explained in the above general formula (III). v is as explained in the above general formula (III-a1).

Furthermore, when M represents —O—C(O)—, $Y^4$ is an alcohol functional group —OH or a halogen atom (preferably chlorine or bromine), and $Y^5$ is a carboxylic acid functional group —C(O)—OH.

When M represents —C(O)—O—, $Y^4$ is a carboxylic acid functional group —C(O)—OH and $Y^5$ is an alcohol functional group —OH or a halogen atom (preferably chlorine or bromine).

When M represents —C(O)—N(H)—, $Y^4$ is a carboxylic acid functional group —C(O)—OH or a —C(O)-halogen group, and $Y^5$ is an amine functional group —$NH^2$.

When M represents —N(H)—C(O)—, $Y^4$ is an amine functional group —$NH_2$ and $Y^5$ is a carboxylic acid functional group —C(O)—OH or a —C(O)-halogen group.

When M represents —S—, $Y^4$ is a halogen atom and $Y^5$ is a mercapto functional group —SH, or $Y^4$ is a mercapto functional group —SH and $Y^5$ is a halogen atom.

When M represents —N(H)—, $Y^4$ is a halogen atom and $Y^5$ is an amine functional group-$NH_2$, or $Y^4$ is an amine functional group-$NH_2$ and $Y^5$ is a halogen atom.

When M represents —N($R^a$)—, $Y^4$ is a halogen atom, $Y^5$ is an amine functional group —N(H)($R^a$), or $Y^4$ is an amine functional group —N(H)($R^a$), and $Y^5$ is a halogen atom.

When M represents —O—, $Y^4$ is a halogen atom and $Y^5$ is an alcohol functional group —OH, or alternatively, $Y^4$ is an alcohol functional group —OH and $Y^5$ is a halogen atom.

These esterification, etherification, thioetherification, alkylation or condensation reactions (reactions between amine functional groups and carboxylic acid functional groups) are well known to those skilled in the art. Therefore, a person skilled in the art can select reaction conditions which depend on the chemical properties of the groups of $Y^4$ and $Y^5$, in order to obtain the compounds of general formula (III-a1).

The compounds of the above general formula (III-a12) are available from suppliers such as Sigma-Aldrich (registered trademark) and TCI (registered trademark).

The compounds of the above general formula (III-a11) can be obtained by condensation reaction between a boronic acid of the following general formula (III-a11-1) and at least one kind of diol compounds of the following general formula (III-a11-2) by the following reaction formula 7.

[Reaction formula 7]

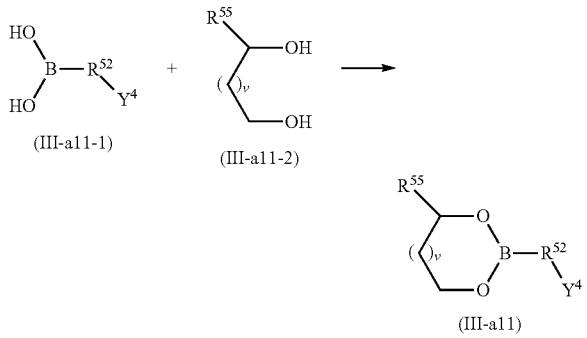

$R^{52}$, $R^{55}$, $Y^4$ and v in the above general formula (III-a11-1) and the above general formula (III-a11-2), are as explained in the above general formula (III), the above general formula (III-a1), and the above general formula (III-a11).

As the compound of general formula (III-a11-2), it is preferable that $R^{55}$ is a methyl group and v=0.

The compounds of the general formula (III-a11-1) and the general formula (III-a11-2) are available from suppliers such as Sigma-Aldrich (registered trademark), Alfa Aesar (registered trademark), and TCI (registered trademark).

<PMA (A)>

PMA (A) contains a constituent unit (Y) derived from a monomer (y) having a diol functional group.

When the requirement (1) is satisfied, PMA (A) contains the constituent units (X1) and (X3) together with the constituent unit (Y) derived from the monomer (y) having a diol-based functional group. PMA (A) may further contain the constituent unit (X2).

When the requirement (2) is satisfied, if the PMA (B) contains the constituent units (X1) and (X3), PMA (A) does not contain the constituent units (X1) and (X3). However, in this case, PMA (A) contains the constituent unit (X2).

When the requirement (2) is satisfied, if the PMA (B) does not contain the constituent units (X1) and (X3), PMA (A) contains the constituent units (X1) and (X3). In this case, PMA (A) may further contain the constituent unit (X2).

(The Content of the Constituent Unit (Y) in PMA (A))

The content of the constituent unit (Y) derived from the monomer (y) having a diol functional group is preferably 1 mass % or more, more preferably 3 mass % or more, even more preferably 5 mass % or more, based on the total constituent units (100 mass %) of PMA (A), from the viewpoint of making it easier to make the reactivity with PMA (B) at high temperatures appropriate. In addition, it is preferably 20 mass % or less, more preferably 15 mass % or less, and even more preferably 12 mass % or less.

The upper limit values and the lower limit values of these numerical ranges can be arbitrarily combined. Specifically, it is preferably 1 mass % to 20 mass %, more preferably 3 mass % to 15 mass %, and even more preferably 5 mass % to 12 mass %.

Furthermore, the content of the constituent unit (Y) derived from the monomer (y) having a diol functional group is preferably 1 mol % or more, more preferably 3 mol % or more, even more preferably 5 mol % or more, based on the total constituent units (100 mol %) of PMA (A), from the viewpoint of making it easier to make the reactivity with PMA (B) at high temperatures appropriate. In addition, it is preferably 20 mol % or less, more preferably 15 mol % or less, and even more preferably 12 mol % or less.

The upper limit values and the lower limit values of these numerical ranges can be arbitrarily combined. Specifically, it is preferably 1 mol % to 20 mol %, more preferably 3 mol % to 15 mol %, and even more preferably 5 mol % to 12 mol %.

(The Content of the Constituent Unit (X2) in PMA (A))

When PMA (A) contains the constituent units (X1) and (X3), the content of a constituent unit (X2) derived from (meth)acrylate (x2) having a linear or branched alkyl group having 10 to 23 carbon atoms in the side chain is preferably 5 mass % or more, more preferably 8 mass % or more, even more preferably 10 mass % or more, based on the total constituent units (100 mass %) of PMA (A), from the viewpoint of making it easier to improve the solubility of PMA (A) in base oil. In addition, it is preferably 30 mass % or less, more preferably 27 mass % or less, and even more preferably 25 mass % or less.

The upper limit values and the lower limit values of these numerical ranges can be arbitrarily combined. Specifically, specifically, it is preferably 5 mass % to 30 mass %, more preferably 8 mass % to 27 mass %, and even more preferably 10 mass % to 25 mass %.

Further, when PMA (A) contains the constituent units (X1) and (X3), the content of a constituent unit (X2) derived from (meth)acrylate (x2) having a linear or branched alkyl group having 10 to 23 carbon atoms in the side chain is preferably 4 mol % or more, more preferably 6 mol % or more, even more preferably 7.0 mol % or more, based on the total constituent units (100 mol %) of PMA (A), from the viewpoint of making it easier to improve the solubility of PMA (A) in base oil. In addition, it is preferably 21 mol % or less, more preferably 19 mol % or less, and even more preferably 18 mol % or less.

The upper limit values and the lower limit values of these numerical ranges can be arbitrarily combined. Specifically, specifically, it is preferably 4 mol % to 21 mol %, more preferably 6 mol % to 19 mol %, and even more preferably 7 mol % to 18 mol %.

When PMA (A) does not contain the constituent units (X1) and (X3), the content of a constituent unit (X2) derived from (meth)acrylate (x2) having a linear or branched alkyl group having 10 to 23 carbon atoms in the side chain is preferably 80 mass % or more, more preferably 85 mass % or more, even more preferably 88 mass % or more, based on the total constituent units (100 mass %) of PMA (A), from the viewpoint of making it easier to improve the solubility of PMA (A) in base oil. In addition, it is preferably 99 mass % or less, more preferably 97 mass % or less, and even more preferably 95 mass % or less.

The upper limit values and the lower limit values of these numerical ranges can be arbitrarily combined. Specifically, specifically, it is preferably 80 mass % to 99 mass %, more preferably 85 mass % to 97 mass %, and even more preferably 88 mass % to 95 mass %.

Further, when PMA (A) does not contain the constituent units (X1) and (X3), the content of a constituent unit (X2) derived from (meth)acrylate (x2) having a linear or branched alkyl group having 10 to 23 carbon atoms in the side chain is preferably 80 mol % or more, more preferably 85 mol % or more, even more preferably 88 mol % or more, based on the total constituent units (100 mol %) of PMA (A), from the viewpoint of making it easier to improve the solubility of PMA (A) in base oil. In addition, it is preferably 99 mol % or less, more preferably 97 mol % or less, and even more preferably 95 mol % or less.

The upper limit values and the lower limit values of these numerical ranges can be arbitrarily combined. Specifically, specifically, it is preferably 80 mol % to 99 mol %, more preferably 85 mol % to 97 mol %, and even more preferably 88 mol % to 95 mol %.

(The Content of the Constituent Unit (X1) in PMA (A))

When PMA (A) contains the constituent unit (X1), the content of a constituent unit (X1) derived from (meth) acrylate (x1) having a linear alkyl group having 4 or less carbon atoms in the side chain is preferably 25 mass % or more, more preferably 29 mass % or more, even more preferably 32 mass % or more, based on the total constituent units (100 mass %) of PMA (A), from the viewpoint of making it easier to improve the viscosity index improving effect. In addition, it is preferably 47 mass % or less, more preferably 45 mass % or less, and even more preferably 43 mass % or less.

The upper limit values and the lower limit values of these numerical ranges can be arbitrarily combined. Specifically, it is preferably 25 mass % to 47 mass %, more preferably 29 mass % to 45 mass %, and even more preferably 32 mass % to 43 mass %.

Further, when PMA (A) contains the constituent unit (X1), the content of a constituent unit (X1) derived from (meth)acrylate (x1) having a linear alkyl group having 4 or less carbon atoms in the side chain is preferably 44 mol % or more, more preferably 50 mol % or more, even more preferably 56 mol % more, based on the total constituent units (100 mol %) of PMA (A), from the viewpoint of making it easier to improve the viscosity index improving effect. In addition, it is preferably 82 mol % or less, more preferably 78 mol % or less, and even more preferably 75 mol % or less.

The upper limit values and the lower limit values of these numerical ranges can be arbitrarily combined. Specifically, it is preferably 44 mol % to 82 mol %, more preferably 50 mol % to 78 mol %, and even more preferably 56 mol % to 75 mol %.

(The Content of the Constituent Unit (X3) in PMA (A))

When PMA (A) contains the constituent unit (X3), the content of a constituent unit (X3) derived from (meth) acrylate (x3) having a branched alkyl group having 24 to 38 carbon atoms in the side chain is preferably 25 mass % or more, more preferably 29 mass % or more, even more preferably 31 mass % or more, based on the total constituent units (100 mass %) of PMA (A), from the viewpoint of making it easier to improve the viscosity index improving effect, and from the viewpoint of making it easier to improve the solubility of PMA (A) in base oil. In addition, it is preferably 47 mass % or less, more preferably 44 mass % or less, and even more preferably 42 mass % or less.

The upper limit values and the lower limit values of these numerical ranges can be arbitrarily combined. Specifically, it is preferably 25 mass % to 47 mass %, more preferably 29 mass % to 44 mass %, and even more preferably 31 mass % to 42 mass %.

Furthermore, when PMA (A) contains the constituent unit (X3), the content of a constituent unit (X3) derived from (meth)acrylate (x3) having a branched alkyl group having 24 to 38 carbon atoms in the side chain is preferably 8.5 mol % or more, more preferably 10 mol % or more, even more preferably 11 mol % or more, based on the total constituent units (100 mol %) of PMA (A), from the viewpoint of making it easier to improve the viscosity index improving effect, and from the viewpoint of making it easier to improve the solubility of PMA (A) in base oil. In addition, it is preferably 16 mol % or less, more preferably 15 mol % or less, and even more preferably 14 mol % or less.

The upper limit values and the lower limit values of these numerical ranges can be arbitrarily combined. Specifically, it is preferably 8.5 mol % to 16 mol %, more preferably 10 mol % to 15 mol %, and even more preferably 11 mol % to 14 mol %.

(The Total Content of the Constituent Units (X1) and (X3) in PMA (A))

When PMA (A) contains the constituent units (X1) and (X3), the total content of a constituent unit(X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain is preferably 50 mass % or more, more preferably 58 mass % or more, even more preferably 63 mass % or more, based on the total constituent units (100 mass %) of PMA (A), from the viewpoint of making it easier to improve the viscosity index improving effect, and from the viewpoint of making it easier to improve the solubility of PMA (A) in base oil. In addition, it is preferably 90 mass % or less, more preferably 87 mass % or less, and even more preferably 85 mass % or less.

The upper limit values and the lower limit values of these numerical ranges can be arbitrarily combined. Specifically, it is preferably 50 mass % to 90 mass %, more preferably 58 mass % to 87 mass %, and even more preferably 63 mass % to 85 mass %.

When PMA (A) contains the constituent units (X1) and (X3), the total content of a constituent unit(X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain is preferably 54 mol % or more, more preferably 63 mol % or more, even more preferably 68 mol % or more, based on the total constituent units (100 mol %) of PMA (A), from the viewpoint of making it easier to improve the viscosity index improving effect, and from the viewpoint of making it easier to improve the solubility of PMA (A) in base oil. In addition, it is preferably 97 mol % or less, more preferably 96 mol % or less, and even more preferably 92 mol % or less. The upper limit values and the lower limit values of these numerical ranges can be arbitrarily combined. Specifically, it is preferably 54 mol % to 97 mol %, more preferably 63 mol % to 96 mol %, and even more preferably 68 mol % to 92 mol %.

(Content Ratio [(X1)/(X3)] of the Above Described Constituent Unit (X1) and the Above Described Constituent Unit (X3) in the PMA (A))

When PMA (A) contains the constituent units (X1) and (X3), the content ratio [(X1)/(X3)] of a constituent unit(X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain is preferably 1/5 to 5/1, more preferably 1/3 to 3/1, even more preferably 1/2 to 2/1, from the viewpoint of making it easier to improve the viscosity index improving effect, and from the viewpoint of making it easier to improve the solubility of PMA (A) in base oil.

(Other Constituent Units in PMA (A))

In addition to the above structural units (X1), (X2), (X3), and (Y), PMA (A) may contain constituent units derived from other monomers as long as they do not impair the effects of the present invention. Examples of the other monomers include functional groups-containing monomers other than monomers (x1), (x2), (x3), and (y).

However, from the viewpoint of making it easier to exhibit the effects of the present invention, the total content of the above constituent units (X1), (X2), (X3), and (Y) in the PMA (A) is, preferably 80 mass % to 100 mass %, more preferably 90 mass % to 100 mass %, even more preferably 95 mass % to 100 mass %, based on the total amount of PMA (A).

(Physical Properties Values of PMA (A))

The mass average molecular weight (Mw) of PMA (A) is preferably 10,000 or more, more preferably 20,000 or more, and still more preferably 25,000 or more, from the viewpoint of making it easier to increase the viscosity index improving effect. Moreover, from the viewpoint of making it easier to improve the shear stability of PMA (A), it is preferably 70,000 or less, more preferably 60,000 or less, and even more preferably 55,000 or less.

The upper limit values and the lower limit values of these numerical ranges can be arbitrarily combined. Specifically, it is preferably 10,000 to 70,000, more preferably 20,000 to 60,000, and even more preferably 25,000 to 55,000.

Further, the molecular weight distribution (Mw/Mn) of PMA (A) is preferably 3.0 or less, more preferably 2.5 or less, even more preferably 2.0 or less, even more preferably 1.8 or less. Note that the lower limit value of the molecular weight distribution (Mw/Mn) of PMA (A) is not particularly limited, however it is preferably 1.01 or more.

Note that the mass average molecular weight (Mw), number average molecular weight (Mn), and molecular weight distribution (Mw/Mn) of PMA (A) are values measured by the method described in Examples described below.

(Polymerization Embodiments of PMA (A))

The polymerization embodiments of PMA (A) is not particularly limited, and may be block copolymerization, random copolymerization, or block/random copolymerization, however random copolymer is preferred.

<PMA(B)>

PMA (B) contains a constituent unit (Z) derived from a monomer (z) having a boronic acid ester.

When the requirement (1) is satisfied, PMA (B) contains the constituent units (X1) and (X3) together with the constituent unit (Z) derived from the monomer (z) having a boronic acid ester. PMA (B) may further contain the constituent unit (X2).

When the requirement (2) is satisfied, if the PMA (A) contains the constituent units (X1) and (X3), PMA (B) does not contain the constituent units (X1) and (X3). However, in this case, PMA (B) contains the constituent unit (X2).

When the requirement (2) is satisfied, if the PMA (A) does not contain the constituent units (X1) and (X3), PMA (B) contains the constituent units (X1) and (X3). In this case, PMA (B) may further contain the constituent unit (X2).

(The Content of the Constituent Unit (Z) in PMA(B))

The content of the constituent unit (Z) derived from the monomer (z) having a boronic acid ester is preferably 1 mass % or more, more preferably 3 mass % or more, even more preferably 5 mass % or more, based on the total constituent units (100 mass %) of PMA (B), from the viewpoint of making it easier to make the reactivity with PMA (A) at high temperatures appropriate. In addition, it is preferably 20 mass % or less, more preferably 15 mass % or less, and even more preferably 12 mass % or less.

The upper limit values and the lower limit values of these numerical ranges can be arbitrarily combined. Specifically, it is preferably 1 mass % to 20 mass %, more preferably 3 mass % to 15 mass %, and even more preferably 5 mass % to 12 mass %.

Furthermore, the content of the constituent unit (Z) derived from the monomer (z) having a boronic acid ester is preferably 0.5 mol % or more, more preferably 2 mol % or more, even more preferably 3 mol % or more, based on the total constituent units (100 mol %) of PMA (B), from the viewpoint of making it easier to make the reactivity with PMA (A) at high temperatures appropriate. In addition, it is preferably 12 mol % or less, more preferably 9 mol % or less, and even more preferably 7 mol % or less.

The upper limit values and the lower limit values of these numerical ranges can be arbitrarily combined. Specifically, it is preferably 0.6 mol % to 12 mol %, more preferably 2 mol % to 9 mol %, and even more preferably 3 mol % to 7 mol %.

(The Content of the Constituent Unit (X2) in PMA(B))

When PMA (B) contains the constituent units (X1) and (X3), the content of a constituent unit (X2) derived from (meth)acrylate (x2) having a linear or branched alkyl group having 10 to 23 carbon atoms in the side chain is preferably 5 mass % or more, more preferably 8 mass % or more, even more preferably 10 mass % or more, based on the total constituent units (100 mass %) of PMA(B), from the viewpoint of making it easier to improve the solubility of PMA (B) in base oil. In addition, it is preferably 30 mass % or less, more preferably 27 mass % or less, and even more preferably 25 mass % or less.

The upper limit values and the lower limit values of these numerical ranges can be arbitrarily combined. Specifically, specifically, it is preferably 5 mass % to 30 mass %, more preferably 8 mass % to 27 mass %, and even more preferably 10 mass % to 25 mass %.

Further, when PMA (B) contains the constituent units (X1) and (X3), the content of a constituent unit (X2) derived from (meth)acrylate (x2) having a linear or branched alkyl group having 10 to 23 carbon atoms in the side chain is preferably 4 mol % or more, more preferably 6 mol % or more, even more preferably 7 mol % or more, based on the total constituent units (100 mol %) of PMA(B), from the viewpoint of making it easier to improve the solubility of PMA (B) in base oil. In addition, it is preferably 21 mol % or less, more preferably 19 mol % or less, and even more preferably 18 mol % or less.

The upper limit values and the lower limit values of these numerical ranges can be arbitrarily combined. Specifically, specifically, it is preferably 4 mol % to 21 mol %, more preferably 6 mol % to 19 mol %, and even more preferably 7 mol % to 18 mol %.

When PMA (B) does not contain the constituent units (X1) and (X3), the content of a constituent unit (X2) derived from (meth)acrylate (x2) having a linear or branched alkyl group having 10 to 23 carbon atoms in the side chain is preferably 80 mass % or more, more preferably 85 mass % or more, even more preferably 88 mass % or more, based on the total constituent units (100 mass %) of PMA(B), from the viewpoint of making it easier to improve the solubility of PMA (B) in base oil. In addition, it is preferably 99 mass % or less, more preferably 97 mass % or less, and even more preferably 95 mass % or less.

The upper limit values and the lower limit values of these numerical ranges can be arbitrarily combined. Specifically, specifically, it is preferably 80 mass % to 99 mass %, more preferably 85 mass % to 97 mass %, and even more preferably 88 mass % to 95 mass %.

Further, when PMA (B) does not contain the constituent units (X1) and (X3), the content of a constituent unit (X2) derived from (meth)acrylate (x2) having a linear or branched alkyl group having 10 to 23 carbon atoms in the side chain is preferably 81 mol % or more, more preferably 86 mol % or more, even more preferably 89 mol % or more, based on the total constituent units (100 mol %) of PMA(B), from the viewpoint of making it easier to improve the solubility of PMA (B) in base oil. In addition, it is preferably 99 mol % or less, more preferably 98 mol % or less, and even more preferably 96 mol % or less.

The upper limit values and the lower limit values of these numerical ranges can be arbitrarily combined. Specifically, specifically, it is preferably 81 mol % to 99 mol %, more preferably 86 mol % to 98 mol %, and even more preferably 89 mol % to 96 mol %.

(The Content of the Constituent Unit (X1) in PMA(B))

When PMA (B) contains the constituent unit (X1), the content of a constituent unit (X1) derived from (meth) acrylate (x1) having a linear alkyl group having 4 or less carbon atoms in the side chain is preferably 25 mass % or more, more preferably 29 mass % or more, even more preferably 32 mass % or more, based on the total constituent units (100 mass %) of PMA(B), from the viewpoint of making it easier to improve the viscosity index improving effect. In addition, it is preferably 47 mass % or less, more preferably 45 mass % or less, and even more preferably 43 mass % or less.

The upper limit values and the lower limit values of these numerical ranges can be arbitrarily combined. Specifically, it is preferably 25 mass % to 47 mass %, more preferably 29 mass % to 45 mass %, and even more preferably 32 mass % to 43 mass %.

Further, when PMA (B) contains the constituent unit (X1), the content of a constituent unit (X1) derived from (meth) acrylate (x1) having a linear alkyl group having 4 or less carbon atoms in the side chain is preferably 45 mol % or more, more preferably 52 mol % or more, even more preferably 58 mol % more, based on the total constituent units (100 mol %) of PMA(B), from the viewpoint of making it easier to improve the viscosity index improving effect. In addition, it is preferably 85 mol % or less, more preferably 81 mol % or less, and even more preferably 77 mol % or less.

The upper limit values and the lower limit values of these numerical ranges can be arbitrarily combined. Specifically, it is preferably 45 mol % to 85 mol %, more preferably 52 mol % to 81 mol %, and even more preferably 58 mol % to 77 mol %.

(The Content of the Constituent Unit (X3) in PMA(B))

When PMA (B) contains the constituent unit (X3), the content of a constituent unit (X3) derived from (meth) acrylate (x3) having a branched alkyl group having 24 to 38 carbon atoms in the side chain is preferably 25 mass % or more, more preferably 29 mass % or more, even more preferably 31 mass % or more, based on the total constituent units (100 mass %) of PMA(B), from the viewpoint of making it easier to improve the viscosity index improving effect, and from the viewpoint of making it easier to improve the solubility of PMA (B) in base oil. In addition, it is preferably 47 mass % or less, more preferably 44 mass % or less, and even more preferably 42 mass % or less.

The upper limit values and the lower limit values of these numerical ranges can be arbitrarily combined. Specifically, it is preferably 25 mass % to 47 mass %, more preferably 29 mass % to 44 mass %, and even more preferably 31 mass % to 42 mass %.

Furthermore, when PMA (B) contains the constituent unit (X3), the content of a constituent unit (X3) derived from (meth)acrylate (x3) having a branched alkyl group having 24 to 38 carbon atoms in the side chain is preferably 8.5 mol % or more, more preferably 10 mol % or more, even more preferably 11 mol % or more, based on the total constituent units (100 mol %) of PMA(B), from the viewpoint of making it easier to improve the viscosity index improving effect, and from the viewpoint of making it easier to improve the solubility of PMA (B) in base oil. In addition, it is preferably 16 mol % or less, more preferably 15 mol % or less, and even more preferably 14 mol % or less.

The upper limit values and the lower limit values of these numerical ranges can be arbitrarily combined. Specifically, it is preferably 8.5 mol % to 16 mol %, more preferably 10 mol % to 15 mol %, and even more preferably 11 mol % to 14 mol %.

(The Total Content of the Constituent Units (X1) and (X3) in PMA(B))

When PMA (B) contains the constituent units (X1) and (X3), the total content of a constituent unit(X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain is preferably 50 mass % or more, more preferably 58 mass % or more, even more preferably 63 mass % or more, based on the total constituent units (100 mass %) of PMA (B), from the viewpoint of making it easier to improve the viscosity index improving effect, and from the viewpoint of making it easier to improve the solubility of PMA (B) in base oil. In addition, it is preferably 90 mass % or less, more preferably 87 mass % or less, and even more preferably 85 mass % or less.

The upper limit values and the lower limit values of these numerical ranges can be arbitrarily combined. Specifically, it is preferably 50 mass % to 90 mass %, more preferably 58 mass % to 87 mass %, and even more preferably 63 mass % to 85 mass %.

When PMA (B) contains the constituent units (X1) and (X3), the total content of a constituent unit(X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain is preferably 54 mol % or more, more preferably 63 mol % or more, even more preferably 68 mol % or more, based on the total constituent units (100 mol %) of PMA(B), from the viewpoint of making it easier to improve the viscosity index improving effect, and from the viewpoint of making it easier to improve the solubility of PMA (B) in base oil. In addition, it is preferably 97 mol % or less, more preferably 96 mol % or less, and even more preferably 92 mol % or less. The upper limit values and the lower limit values of these numerical ranges can be arbitrarily combined. Specifically, it is preferably 54 mol % to 97 mol %, more preferably 63 mol % to 96 mol %, and even more preferably 68 mol % to 92 mol %.

(Content Ratio [(X1)/(X3)] of the Above Described Constituent Unit (X1) and the Above Described Constituent Unit (X3) in the PMA(B))

When PMA (B) contains the constituent units (X1) and (X3), the content ratio [(X1)/(X3)] of a constituent unit (X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain is preferably 1/5 to 5/1, more preferably 1/3 to 3/1, even more preferably 1/2 to 2/1, from the viewpoint of making it easier to improve the viscosity index improving effect, and from the viewpoint of making it easier to improve the solubility of PMA (B) in base oil.

(Other Constituent Units in PMA(B))

In addition to the above structural units (X1), (X2), (X3), and (Z), PMA (B) may contain constituent units derived from other monomers as long as they do not impair the effects of the present invention. Examples of the other monomers include functional groups-containing monomers other than monomers (x1), (x2), (x3), and (z).

However, from the viewpoint of making it easier to exhibit the effects of the present invention, the total content of the above constituent units (X1), (X2), (X3), and (Z) in the PMA (B) is, preferably 80 mass % to 100 mass %, more preferably 90 mass % to 100% by mass, even more preferably 95 mass % to 100 mass %.

(Physical Properties Values of PMA(B))

The mass average molecular weight (Mw) of PMA (B) is preferably 10,000 or more, more preferably 20,000 or more, and still more preferably 25,000 or more, from the viewpoint of making it easier to increase the viscosity index improving effect. Moreover, from the viewpoint of making it easier to improve the shear stability of PMA (A), it is preferably 70,000 or less, more preferably 60,000 or less, and even more preferably 55,000 or less.

The upper limit values and the lower limit values of these numerical ranges can be arbitrarily combined. Specifically, it is preferably 10,000 to 70,000, more preferably 20,000 to 60,000, and even more preferably 25,000 to 55,000.

Further, the molecular weight distribution (Mw/Mn) of PMA (B) is preferably 3.0 or less, more preferably 2.5 or less, even more preferably 2.0 or less, even more preferably 1.8 or less. Note that the lower limit value of the molecular weight distribution (Mw/Mn) of PMA (B) is not particularly limited, however it is preferably 1.01 or more.

Note that the mass average molecular weight (Mw), number average molecular weight (Mn), and molecular weight distribution (Mw/Mn) of PMA (B) are values measured by the method described in Examples described below.

(Polymerization Embodiments of PMA (B))

The polymerization embodiments of PMA (B) is not particularly limited, and may be block copolymerization, random copolymerization, or block/random copolymerization, however random copolymer is preferred.

<Method for Producing PMA (A) and PMA (B)>

PMA (A) and PMA (B) can be produced by polymerizing each of the above monomers in a polymerization solvent.

When PMA (A) and PMA (B) are produced by solution polymerization, they can be obtained by polymerizing each of the above monomers and, if necessary, other monomers using a polymerization initiator in a polymerization solvent.

Examples of the polymerization initiator include one or more selected from the group consisting of azo initiators, peroxide initiators, redox initiators, and organic halogen compound initiators. As the polymerization initiator used in the polymerization of PMA (A) and PMA (B), preferably one or more selected from azo initiators and peroxide initiators, more preferably one or more selected from azo initiators and organic peroxides, even more preferably an azo type initiator, can be used.

Examples of the azo polymerization initiator include 2,2'-azobis(isobutyronitrile), 2,2'-azobis(2-methylbutyronitrile), 2,2'-azobis(2,4-dimethyl Valeronitrile), 4,4'-azobis(4-cyanovaleric acid) and its salts (for example, hydrochloride), dimethyl 2,2'-azobisisobutyrate, 2,2'-azobis(2-amidinopropane) hydrochloride, and 2,2'-azobis[2-methyl-N-(2-hydroxyethyl)propionamide].

Examples of peroxide initiators include inorganic peroxide, and organic peroxides.

Examples of the inorganic peroxide include hydrogen peroxide, ammonium persulfate, potassium persulfate, and sodium persulfate.

Examples of organic peroxides include benzoyl peroxide, di-tert-butyl peroxide, cumene hydroperoxide, succinic acid peroxide, di(2-ethoxyethyl) peroxydicarbonate, tert-butyl peroxypivalate, tert-hexyl peroxy pivalate, tert-butyl peroxy neoheptanoate, tert-butyl peroxy neodecanoate, tert-butyl peroxy 2-ethylhexanoate, tert-butyl peroxy isobutyrate, tert-amylperoxy 2-ethylhexanoate, 1,1,3,3-tetramethylbutylperoxy 2-ethylhexanoate, dibutylperoxytrimethyl adipate, and lauryl peroxide.

Examples of the redox initiators include combinations of reducing agents such as sulfites or bisulfites of alkali metal (for example, ammonium sulfite and ammonium bisulfite), ferrous chloride, ferrous sulfate, and ascorbic acid, with oxidizing agents such as persulfates of alkali metal, ammonium persulfates, hydrogen peroxide, organic peroxides.

In addition, as mentioned above, when the conversion rate of the constituent monomers does not reach 98% during polymerization of PMA (A) and PMA (B), for example, by adding an additional polymerization initiator to the polymerization system, the conversion rate can be increased to the above conversion rate.

During polymerization, a known chain transfer agent may be used as necessary for the purpose of adjusting the physical properties of the copolymer such as molecular weight, and the like.

Examples of the chain transfer agents include secondary alcohols such as mercaptans, thiocarboxylic acids, and isopropanol, amines such as dibutylamine, hypophosphites such as sodium hypophosphite, chlorine-containing compounds, and alkylbenzene compounds.

Examples of mercaptans include alkyl mercaptan compounds having an alkyl group having 2 to 20 carbon atoms, such as n-butyl mercaptan, isobutyl mercaptan, n-octyl mercaptan, n-dodecyl mercaptan, sec-butyl mercaptan, tert-butyl mercaptan, and tert-dodecyl mercaptan; and hydroxyl group-containing mercaptan compounds such as mercaptoethanol and mercaptopropanol.

Examples of thiocarboxylic acids include thioglycolic acid, and thiomalic acid.

The amounts of the polymerization initiator and chain transfer agent to be used can be appropriately selected in consideration of the physical properties of the desired copolymer (for example, adjustment of molecular weight).

Examples of the method for controlling polymerization include adiabatic polymerization and temperature-controlled polymerization. The reaction temperature during polymerization is preferably 30 to 140° C., more preferably 50 to 130° C., and even more preferably 70 to 120° C.

In addition to the method for initiating polymerization using heat, a method for initiating polymerization by irradiating with radiation, electron beams, ultraviolet rays, and the like, can also be adopted. The temperature-controlled solution polymerization is preferred. The copolymerization embodiments may be block copolymerization, random copolymerization, or block/random copolymerization, however random copolymer is preferred.

In addition, when producing PMA (A), as the monomer (y), a monomer having a diol group protected with a protecting group as represented by the above general formula (II-B) may be used. In this case, deprotection may be performed before the start of polymerization or after polymerization.

<The Total Content of PMA (A) and PMA (B) in the Viscosity Index Improver Composition>

The viscosity index improver composition of the embodiment may or may not contain other viscosity index improver other than the PMA (A) and the PMA (B) within a range that does not significantly impair the effects of the present invention.

However, from the viewpoint of making it easier to exhibit the effects of the present invention when added to the lubricating base oil, the total content of PMA (A) and PMA (B) is preferably 50 mass % or more, more preferably 60 mass % or more, even more preferably 70 mass % or more, even further preferably 80 mass % or more, particularly preferably 90 mass % or more, significantly preferably 95 mass % or more, based on the total amount of the viscosity index improver composition.

Furthermore, considering the purity of PMA (A) and PMA (B), the total content of PMA (A) and PMA (B) is usually less than 100 mass %, based on the total amount of the viscosity index improver composition.

Note that the viscosity index improver composition of the embodiment may be diluted with a diluent solvent from the viewpoint of handleability. The total content of PMA (A) and PMA (B) in the above viscosity index improver composition means the content based on the total amount of active ingredients (resin content) in the viscosity index improver composition, excluding the diluent solvent.

As the diluting solvent, it is preferable to use the same solvent as the above polymerization solvent.

<Content Ratio of PMA (A) and PMA (B) in the Viscosity Index Improver Composition>

The content ratio of the PMA (A) and the PMA (B) in the viscosity index improver composition of this embodiment is preferably 1/5 to 5/1, more preferably 1/3 to 3/1, even more preferably 1/2 to 2/1, in molar ratio.

<Additive Composition for Lubricating Oil>

The viscosity index improver composition of this embodiment may be provided as an additive composition for lubricating oil (for example, additive packages for lubricating oil compositions) further containing one or more additives selected from the group consisting of a metallic detergent, an abrasion resistant agent, an ash-free dispersant, an extreme pressure agent, a pour point depressant, an antioxidant, an anti-foaming agent, a surfactant, a demulsifier, a friction modifier, an oiliness-improving agent, a rust inhibitor, and a metal deactivator.

Details of one or more additives selected from the group consisting of a metallic detergent, an abrasion resistant agent, an ash-free dispersant, an extreme pressure agent, a pour point depressant, an antioxidant, an anti-foaming agent, a surfactant, a demulsifier, a friction modifier, an oiliness-improving agent, a rust inhibitor, and a metal deactivator, will be described later.

[Lubricating Oil Composition]

The lubricating oil composition of this embodiment contains the viscosity index improver composition of this embodiment, and a lubricating base oil.

The content of the viscosity index improver composition (equivalent value of resin content) is preferably 1 mass % or more, more preferably 2 mass % or more, even more preferably 3 mass % or more, based on the total amount (100 mass %) of the lubricating oil composition, from the viewpoint of making it easier to exhibit the viscosity index improving effect. In addition, it is preferably 20 mass % or less, more preferably 15 mass % or less, and even more preferably 12 mass % or less, from the viewpoint of reducing the viscosity of the lubricating oil composition.

The upper limit values and the lower limit values of these numerical ranges can be arbitrarily combined. Specifically, it is preferably 1 mass % to 20 mass %, more preferably 2 mass % to 15 mass %, and even more preferably 3 mass % to 12 mass %.

<Lubricating Base Oil>

As the lubricating base oil, any general base oil used in lubricating oil compositions can be used without particular limitation. Specifically, examples include one or more types selected from the group consisting of mineral oil and synthetic oil.

The kinematic viscosity at 100° C. of the lubricating base oil is preferably in the range of 1 $mm^2/s$ to 50 $mm^2/s$, more preferably in the range of 2 $mm^2/s$ to 30 $mm^2/s$, and more preferably in the range of 3 $mm^2/s$ to 20 $mm^2/s$.

Further, the viscosity index of the lubricating base oil is preferably 80 or more, more preferably 90 or more, and even more preferably 100 or more.

The kinematic viscosity and viscosity index of the lubricating base oil are the values measured or calculated according to JIS K2283:2000.

Specific examples of lubricating base oils are listed below.

Examples of the mineral oils include, for example, distillate oil obtained by atmospheric distillation and/or vacuum distillation of paraffinic crude oil, intermediate crude oil, or naphthenic crude oil; and refined oil obtained by refining the distillate oil according to a conventional method. Examples of the refining method for obtaining the refined oil include solvent dewaxing treatment, hydroisomerization treatment, hydrofinishing treatment, and clay treatment.

Examples of synthetic oils include hydrocarbon oils, aromatic oils, ester oils, and ether oils. Further, as the synthetic oil, GTL (Gas To Liquids) obtained by isomerizing wax (GTL wax, Gas To Liquids WAX) produced by the Fischer-Tropsch method or the like from natural gas may be used.

In addition, from the viewpoint of further improving the viscosity index improving effect of the viscosity index improver composition of this embodiment, the lubricating base oil preferably contains an ester oil.

When the lubricating base oil contains the ester oils, the content of the ester oils in the lubricating base oil is preferably from 50 mass % to 100 mass %, more preferably from 60 mass % to 100 mass %, even more preferably from 70 mass % to 100 mass %, even further preferably from 80 mass % to 100 mass %, and specifically preferably from 90 mass % to 100 mass % based on the total amount of the lubricating base oil.

<Additives Other than Viscosity Index Improver Composition>

The lubricating oil composition of the embodiment may further contain one or more additives (hereinafter, also referred to as "other additives") selected from the group consisting of a metallic detergent, an abrasion resistant agent, an ash-free dispersant, an extreme pressure agent, a pour point depressant, an antioxidant, an anti-foaming agent, a surfactant, a demulsifier, a friction modifier, an oiliness-improving agent, a rust inhibitor, and a metal deactivator, as long as they do not impair the effect of the viscosity index improver composition of the embodiment.

When the lubricating oil composition of the present embodiment contains the other additives, the content of each of the other additives is preferably 0.001 mass % to 15 mass %, more preferably 0.005 mass % to 10 mass %, even more preferably 0.01 mass % to 8 mass %, based on the total amount of the lubricating oil composition (100 mass %).

Further, when the lubricating oil composition of the embodiment contain the other additives, the total content of the additives is preferably more than 0 mass % and 30 mass % or less, more preferably 0.001 to 25 mass %, even more preferably 0.001 to 20 mass %, and even further preferably 0.001 to 15 mass %, based on the total amount (100 mass %) of the lubricating oil composition.

Note that the lubricating oil composition of the embodiment may contain the viscosity index improver composition of the embodiment and other additives, by containing the above-mentioned additive composition for lubricating oil (lubricating oil package) and lubricating base oil.

(Metallic Detergent)

Examples of metallic detergent include organic acid metal salt compounds containing metal atoms selected from alkali metals and alkaline earth metals, specifically, metal salicylates, metal phenates, and metal sulfonates which contain metal atoms selected from alkali metals and alkaline earth metals.

In addition, in this description, "alkali metal" refers to lithium, sodium, potassium, rubidium, cesium, and francium.

Moreover, "alkaline earth metal" refers to beryllium, magnesium, calcium, strontium, and barium.

As the metal atoms contained in the metallic detergent, sodium, calcium, magnesium, or barium are preferred, and calcium is more preferred, from the viewpoint of improving cleanliness at high temperatures.

Furthermore, among the metallic detergents, one or more selected from calcium salicylate, calcium phenate, and calcium sulfonate is preferred from the viewpoint of improving cleanliness at high temperatures and from the viewpoint of solubility in base oil.

The metallic detergent may be a neutral salt, a basic salt, an overbased salt, or a mixture thereof.

The total base number of the metallic detergent is preferably 0 to 600 mgKOH/g.

When the metallic detergent is a basic salt or an overbased salt, the base number of the metallic detergent is preferably 10 to 600 mgKOH/g, more preferably 20 to 500 mgKOH/g.

In the description, the "base number" means a base number according to a perchloric acid method that is measured in accordance with 7 of "Petroleum products and lubricants—Determination of neutralization number" of JIS K2501:2003.

In the lubricating oil composition of the embodiment, when a metallic detergent is contained as other additive, the content of the metallic detergent is preferably 0.01 to 10 mass % based on the total amount (100 mass) of the lubricating oil composition.

The metallic detergent may be used alone or may be used in combination of two or more thereof.

(Abrasion Resistant Agent)

Examples of the abrasion resistant agent include zinc dialkyldithiophosphate (ZnDTP) and zinc phosphate, sulfur-containing compounds such as disulfides, olefin sulfides, sulfurized oils and fats, sulfurized esters, thiocarbonates, thiocarbamates, and polysulfides; phosphorus-containing compounds such as phosphite esters, phosphate esters, phosphonate esters, and amine salts or metal salts thereof; and sulfur and phosphorus-containing anti-wear agents such as thiophosphite esters, thiophosphate esters, thiophosphonate esters, and amine salts or metal salts thereof.

Among these, zinc dialkyldithiophosphate (ZnDTP) is preferred.

In the lubricating oil composition of the embodiment, when an abrasion resistant agent is contained as other additive, the content of the abrasion resistant agent is preferably 0.05 to 5.0 mass % based on the total amount (100 mass %) of the lubricating oil composition.

The abrasion resistant agent may be used alone or may be used in combination of two or more thereof.

(Ash-Free Dispersant)

Examples of the ash-free dispersant include succinimide, benzylamine, succinate ester, and boron-modified products thereof, however alkenyl succinimide and boron-modified alkenyl succinimide are preferred.

Examples of the alkenyl succinimide include alkenyl succinic acid monoimide represented by the following general formula (i) or alkenyl succinic acid bisimide represented by the following general formula (ii).

The alkenyl succinimide may be a modified alkenyl succinimide in which a compound represented by the following general formula (i) or (ii) is reacted with one or more selected from alcohols, aldehydes, ketones, alkylphenols, cyclic carbonates, epoxy compounds, organic acids, and the like.

Further, examples of the boron-modified alkenylsuccinimide include boron-modified compounds represented by the following general formula (i) or (ii).

(i)

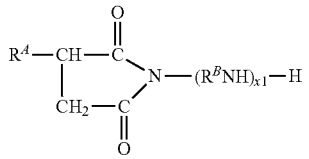

(ii)

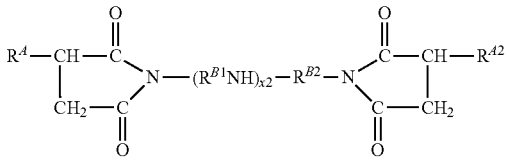

In the general formulas (i) and (ii), $R^A$, $R^{A1}$ and $R^{A2}$ are each independently an alkenyl group having a mass average molecular weight (Mw) of 500 to 3,000 (preferably 1,000 to 3,000), and polybutenyl group or polyisobutenyl group is preferred.

$R^B$, $R^{B1}$ and $R^{B2}$ are each independently an alkylene group having 2 to 5 carbon atoms.

x1 is an integer of 1 to 10, preferably an integer of 2 to 5, more preferably 3 or 4.

x2 is an integer of 0 to 10, preferably an integer of 1 to 4, more preferably 2 or 3.

From the viewpoint of improving cleanliness, the ratio [B/N] of boron atoms to nitrogen atoms constituting the boron-modified alkenylsuccinimide is preferably 0.5 or more, more preferably 0.6 or more, and even more preferably 0.8 or more, even further preferably 0.9 or more.

In the lubricating oil composition of the embodiment, when an ash-free dispersant is contained as other additive, the content of the ash-free dispersant is preferably 0.1 to 20 mass % based on the total amount (100 mass %) of the lubricating oil composition.

The ash-free dispersant may be used alone or may be used in combination of two or more thereof.

(Extreme Pressure Agent)

Examples of extreme pressure agents include sulfur-based extreme pressure agents such as sulfides, sulfoxides, sulfones, and thiophosphinates, halogen-based extreme pressure agents such as chlorinated hydrocarbons, and organometallic extreme-pressure agents. Moreover, among the above-mentioned abrasion resistant agent, compounds having a function as an extreme pressure agent can also be used.

In the lubricating oil composition of the embodiment, when an extreme pressure agent is contained as other additive, the content of the extreme pressure agent is preferably 0.1 to 10 mass % based on the total amount (100 mass %) of the lubricating oil composition.

Note that the extreme pressure agent may be used alone or may be used in combination of two or more thereof.

(Antioxidant)

As the antioxidant, any one can be appropriately selected and used from the known antioxidants conventionally used as antioxidants in lubricating oils, the examples include amine-based antioxidants, phenolic antioxidants, molybdenum antioxidants, sulfur-based antioxidants, and phosphorus-based antioxidants.

Examples of amine-based antioxidants include diphenylamine-based antioxidants such as diphenylamine and alkylated diphenylamines having an alkyl group having 3 to 20 carbon atoms; and naphthylamine antioxidants such as α-naphthylamine, phenyl-α-naphthylamine, and substituted phenyl-α-naphthylamine having alkyl groups having 3 to 20 carbon atoms.

Examples of phenolic antioxidants include monophenolic antioxidants such as 2,6-di-tert-butylphenol, 2,6-di-tert-butyl-4-methylphenol, 2,6-di-tert-butyl-4-ethylphenol, isooctyl-3-(3,5-di-tert-butyl-4-hydroxyphenyl)propionate and octadecyl-3-(3,5-di-tert-butyl-4-hydroxyphenyl)propionate; diphenolic antioxidants such as 4,4'-methylenebis(2,6-di-tert-butylphenol) and 2,2'-methylenebis(4-ethyl-6-tert-butylphenol); and hindered phenol-based antioxidants.

Examples of molybdenum-based antioxidants include molybdenum amine complexes obtained by reacting molybdenum trioxide and/or molybdic acid with an amine compound.

Examples of the sulfur-based antioxidant include dilauryl-3,3'-thiodipropionate.

Examples of phosphorus antioxidants include phosphites. In addition, when using a phosphorus-based antioxidant, it is preferable to use an amount which satisfies a content of the suitable phosphorus atom of the lubricating oil composition described below.

In the embodiment, these antioxidants can be contained alone or in any combination of two or more, and preferably include a phenolic antioxidant and/or an amine antioxidant.

In the lubricating oil composition of the embodiment, when an antioxidant is contained as other additive, the content of the antioxidant is preferably 0.05 to 7 mass % based on the total amount (100 mass %) of the lubricating oil composition.

(Pour Point Depressants)

Examples of the pour point depressant include, for example, ethylene-vinyl acetate copolymer, condensates of chlorinated paraffins and naphthalene, condensates of chlorinated paraffins and phenols, polymethacrylate-based (PMA-based; polyalkyl (meth)acrylate, etc.), polyvinyl acetate, and polybutene, polyalkylstyrene, and polymethacrylate-based is preferably used.

In the lubricating oil composition of the embodiment, when a pour point depressant is contained as other additive, the content of the pour point depressant is preferably 0.01 to 10 mass % based on the total amount (100 mass %) of the lubricating oil composition.

The pour point depressants may be used alone or in combination of two or more.

(Anti-Foaming Agent)

Examples of the anti-foaming agent include silicone oils such as dimethylpolysiloxane, fluorosilicone oils and fluoroalkyl ethers.

In the lubricating oil composition of the embodiment, when an anti-foaming agent is contained as other additive, the content of the anti-foaming agent is preferably 0.05 to 5 mass % based on the total amount (100 mass %) of the lubricating oil composition.

Note that the anti-foaming agent may be used alone or may be used in combination of two or more thereof.

(Surfactant or Emulsifier)

Examples of the surfactant or demulsifier include polyalkylene glycol nonionic surfactants such as polyoxyethylene alkyl ether, polyoxyethylene alkyl phenyl ether, and polyoxyethylene alkyl naphthyl ether.

In the lubricating oil composition of the embodiment, when a surfactant or demulsifier is contained as other additive, the content of the surfactant or the demulsifier is each independently preferably 0.01 to 3 mass % based on the total amount (100 mass %) of the lubricating oil composition.

Note that the surfactant or the demulsifier may be used alone or may be used in combination of two or more thereof.

(Friction Modifier)

Examples of friction modifiers include molybdenum-based friction modifiers such as molybdenum dithiocarbamate (MoDTC), molybdenum dithiophosphate (MoDTP), and amine salts of molybtenic acid; ash-free friction modifiers such as aliphatic amines containing at least one of alkyl group or alkenyl group having 6 to 30 carbon atoms, fatty acid esters, fatty acid amides, fatty acids, aliphatic alcohols, and aliphatic ethers; oils and fats, amines, amides, sulfurized esters, phosphoric esters, phosphorous esters, and phosphate ester amine salts.

In the lubricating oil composition of the embodiment, when a friction modifier is contained as other additive, the content of the friction modifier is preferably 0.05 to 4 mass % based on the total amount (100 mass %) of the lubricating oil composition.

Note that the friction modifier may be used alone or may be used in combination of two or more thereof.

(Oiliness-Improving Agent)

Examples of the oiliness-improving agent include aliphatic saturated or unsaturated monocarboxylic acids such as stearic acid and oleic acid, polymerized fatty acids such as dimer acid and hydrogenated dimer acid, hydroxy fatty acids such as ricinoleic acid and 12-hydroxystearic acid, aliphatic saturated or unsaturated monoalcohols such as lauryl alcohol and oleyl alcohol, aliphatic saturated or unsaturated monoamines such as stearylamine and oleylamine, aliphatic saturated or unsaturated monocarboxylic acid amides such as lauric acid amide and oleic acid amide, and partial esters of polyhydric alcohols such as glycerin and sorbitol and aliphatic saturated or unsaturated monocarboxylic acids.

In the lubricating oil composition of the embodiment, when an oiliness-improving agent is contained as other additive, the content of the oiliness-improving agent is preferably 0.01 to 5 mass % based on the total amount (100 mass %) of the lubricating oil composition.

Note that the oiliness-improving agent may be used alone or may be used in combination of two or more thereof.

(Rust Inhibitor)

Examples of the rust inhibitor include a fatty acid, an alkenyl succinic acid half ester, a fatty acid soap, an alkyl sulfonic acid salt, a polyhydric alcohol fatty acid ester, a fatty acid amine, oxidized paraffin, and an alkyl polyoxyethylene ether.

In the lubricating oil composition of the embodiment, when a rust inhibitor is contained as other additive, the content of the rust inhibitor is preferably 0.01 to 3 mass % based on the total amount (100 mass %) of the lubricating oil composition.

Note that the rust inhibitor may be used alone or may be used in combination of two or more thereof.

(Metal Deactivator)

Examples of the metal deactivator include a benzotriazole compound, a tolyltriazole compound, a thiadiazole compound, an imidazole compound, and a pyrimidine compound.

In the lubricating oil composition of the embodiment, when a metal deactivator is contained as other additive, the content of the metal deactivator is preferably 0.01 to 5 mass % based on the total amount (100 mass %) of the lubricating oil composition.

Note that the metal deactivator may be used alone or may be used in combination of two or more thereof.

<Physical Properties of Lubricating Oil Composition>

(Kinematic Viscosity, Viscosity Index)

The kinematic viscosity at 100° C. of the lubricating oil composition of the present embodiment is preferably 1.0 $mm^2/s$ to 50 $mm^2/s$, more preferably 2.0 $mm^2/s$ to 30 $mm^2/s$, and even more preferably 3.0 $mm^2/s$ to 20 $mm^2/s$.

The viscosity index of the lubricating oil composition of the present embodiment is preferably 220 or more, more preferably 230 or more, even more preferably 240 or more, even further preferably 250 or more.

The kinematic viscosity and viscosity index of the lubricating oil composition are the values measured or calculated according to JIS K2283:2000.

[Application of Lubricating Oil Composition]

The lubricating oil composition of the embodiment has excellent viscosity index since it contains the viscosity index improver composition of the embodiment.

Therefore, the lubricating oil composition of the embodiment can be suitably used for various purposes, for example, drive system oils such as gear oil (manual transmission oil, differential oil, etc.), automatic transmission oil (automatic transmission oil, etc.), continuously variable transmission oil (belt CVT oil, toroidal CVT oil, etc.), power steering oil, shock absorber oil, and electric motor oil; oils for internal combustion engines such as gasoline engines, diesel engines, and gas engines; equipment oils such as hydraulic oil, turbine oil, and compressor oil; fluid bearing oils; rolling bearing oil; refrigerating machine oils.

[Method for Producing Lubricating Oil Composition]

A method for producing a lubricating oil composition of the embodiment is not particularly limited, however for example, it contains a step of mixing a lubricating base oil, the PMA (A) and the PMA (B), and satisfying the requirement (1) or (2).

In the above step, it is not limited to mixing of the lubricating base oil, the PMA (A), and the PMA (B) at once, however the PMA (B) may be blended and mixed after blending and mixing the PMA (A) into the lubricating base oil, or the PMA (A) may be blended and mixed after mixing and blending the PMA (B) into the lubricating base oil. Of course, the PMA (A) and the PMA (B) may be simultaneously blended and mixed in the lubricating base oil. When the PMA (A) and the PMA (B) are simultaneously blended and mixed in the lubricating base oil, the viscosity index improver composition of the embodiment is preferably blended and mixed into the lubricating base oil.

Note that the PMA (A) and the PMA (B) may also be blended in the form of a solution (dispersion) with the addition of dilution oil or the likes. Alternatively, it may be blended as a dispersed form in a polymerization solvent without removing the polymerization solvent used during polymerization.

The method for producing the lubricating oil composition of the embodiment may or may not further include the step of blending additives other than the viscosity index improver composition of the embodiment into the lubricating base oil, as described above.

When the additive is blended in the lubricating base oil, the additive may be blended after being made into a solution (dispersion) form by adding a diluent oil or the likes.

Alternatively, the viscosity index improver composition of the embodiment may be blended with the additives other than the viscosity index improver composition at one time, by blending the additive composition for lubricating oil of the embodiment into the lubricating base oil.

In addition, in the method for producing a lubricating oil composition of the embodiment, preferred embodiments of the lubricating base oil and preferred embodiments of PMA (A) and PMA (B) are as described above.

[Lubricating Method Using Lubricating Oil Composition]

Examples of the lubricating method using the lubricating oil composition of the embodiment include a method for lubricating each components according to each of the devices by filling the lubricating oil composition of the embodiment in to the device used in each of the above-mentioned applications.

One Embodiment of the Present Invention Provided

According to one embodiment of the present invention, the following [1] to [15] are provided.

[1]A viscosity index improver composition containing:

the following poly(meth)acrylate (A); and the following poly(meth)acrylate (B), and satisfying the following requirement (1) or (2), Poly(meth)acrylate (A): containing a constituent unit (Y) derived from a monomer (y) having a diol functional group, Poly(meth)acrylate (B): containing a constituent unit (Z) derived from a monomer (z) having a boronic acid ester, Requirement (1): Both of the poly(meth)acrylate (A) and the poly(meth)acrylate (B) contain a constituent unit (X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain, and both of the poly(meth)acrylate (A) and the poly(meth)acrylate (B) may further contain a constituent unit (X2) derived from (meth)acrylate (x2) having a linear or branched alkyl group which has 10 to 23 carbon atoms in the side chain, Requirement (2): One of the poly(meth)acrylate (A) and the poly(meth)acrylate (B) contains a constituent unit (X1) derived from (meth)acrylate (x1) having a linear alkyl group which has 4 or less of carbon atoms in the side chain, and a constituent unit (X3) derived from (meth)acrylate (x3) having a branched alkyl group which has 24 to 38 of carbon atoms in the side chain, and at least the other of the poly (meth)acrylate (A) and the poly(meth)acrylate (B) contains a constituent unit (X2) derived from (meth) acrylate(x2) having a linear or branched alkyl group which has 10 to 23 carbon atoms in the side chain.

[2] The viscosity index improver composition according to the above item [1], in which the poly(meth)acrylate (A) has a mass average molecular weight (Mw) of 10,000 to 70,000.

[3] The viscosity index improver composition according to the above item [1] or [2], in which the poly(meth)acrylate (B) has a mass average molecular weight (Mw) of 10,000 to 70,000.

[4] The viscosity index improver composition according to any one of the above items [1] to [3], in which when the poly(meth)acrylate (A) contains the constituent unit (X1) and the constituent unit (X3), a total content of the constituent unit (X1) and the constituent unit (X3) is 50 mass % or more, based on all constituent units of the poly(meth)acrylate (A).

[5] The viscosity index improver composition according to any of the above items [1] to [4], in which when the poly(meth)acrylate (A) contains the constituent unit (X1) and the constituent unit (X3), a content ratio [(X1)/(X3)] of the constituent unit (X1) and the constituent unit (X3) is 1/5 to 5/1 in mass ratio.

[6] The viscosity index improver composition according to any of the above items [1] to [5], in which when the poly(meth)acrylate (B) contains the constituent unit (X1) and the constituent unit (X3), a total content of the constituent unit (X1) and the constituent unit (X3) is 50 mass % or more, based on all constituent units of the poly(meth)acrylate (B).

[7] The viscosity index improver composition according to any of the above items [1] to [6], in which when the poly(meth)acrylate (B) contains the constituent unit (X1) and the constituent unit (X3), a content ratio [(X1)/(X3)] of the constituent unit (X1) and the constituent unit (X3) is 1/5 to 5/1 in mass ratio.

[8] The viscosity index improver composition according to any of the above items [1] to [5], which satisfies the requirement (1).

[9] The viscosity index improver composition according to any of the above items [1] to [8], in which the alkyl group contained in the (meth)acrylate (x1) is a methyl group.

[10] The viscosity index improver composition according to any of the above items [1] to [9], in which the (meth)acrylate (x3) is a compound represented by the following general formula (1-3), (I-3)

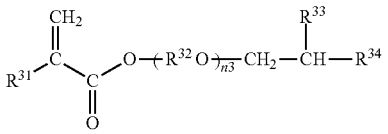

[in the general formula (I-3), $R^{31}$ represents a hydrogen atom or a methyl group, $R^{32}$ represents a linear or branched alkylene group having 2 to 4 carbon atoms, and $R^{33}$ and $R^{34}$ each independently represent a linear or branched alkyl group. Total carbon number of the alkyl groups which can be selected as $R^{33}$ and $R^{34}$ is 22 to 36. n3 represents a integer of 0 to 20. When n3 is 2 or more, a plurality of $R^{32}$'s may be the same or different.]

[11] The viscosity index improver composition according to any of the above items [1] to [10], in which a monomer (y) having the diol functional group is a compound represented by the following general formula (II), (II)

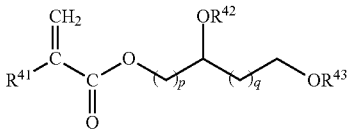

[in the general formula (II), $R^{41}$ represents a hydrogen atom or a methyl group, p represents an integer of 2 to 18, q is 0 or 1, $R^{42}$ and $R^{43}$ each independently represent a hydrogen, a tetrahydropyranyl group, a methyloxymethyl group, a tert-butyl group, a benzyl group, a trimethylsilyl group, or a tert-butyldimethylsilyl group, or $R^{42}$ and $R^{43}$ form a bridge represented by the following general formula (IIa) with an oxygen atom, (IIa)

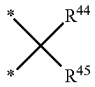

in the general formula (IIa), * is a bonding position with the oxygen atom, $R^{44}$ and $R^{45}$ each independently represents a hydrogen atom or an alkyl group having 1 to 11 carbon atoms, or $R^{42}$ and $R^{43}$ form a boronic acid ester represented by the following general formula (IIb) with an oxygen atom, (IIb)

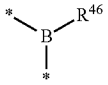

in the general formula (IIb), * is a bonding position with the oxygen atom, and $R^{46}$ is an aryl group having 6 to 18 carbon atoms, an aralkyl group having 7 to 18 carbon atoms, or an alkyl group having 2 to 18 carbon atoms].

[12] The viscosity index improver composition according to any of the above items [1] to [11], in which a monomer (z) having the boronic acid ester is a compound represented by the following general formula (III), (III)

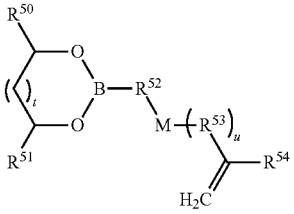

[in the general formula (III) t represents 0 or 1, u represents 0 or 1, $R^{50}$ and $R^{51}$ each independently represent a hydrogen atom or a hydrocarbon-containing chain having 1 to 24 carbon atoms, $R^{52}$ and $R^{53}$ each independently represent an arylene group having 6 to 18 carbon atoms, an aralkylene group having 7 to 24 carbon atoms, and an alkylene group having 2 to 24 carbon atoms, M represents —O—C(O)—, —C(O)—O—, —C(O)—N(H)—, —N(H)—C(O)—, —S—, —N(H)—, —N($R^a$)—, or —O—, (in which $R^a$ is a hydrocarbon-containing chain having 1 to 15 carbon atoms), $R^{54}$ represents a hydrogen atom or a methyl group].

[13] An additive composition for lubricating oil containing:

the viscosity index improver composition according to any of the above items [1] to [12]; and one or more additives selected from the group consisting of a metallic detergent, an abrasion resistant agent, an ash-free dispersant, an extreme pressure agent, a pour point depressant, an antioxidant, an antifoaming agent, a surfactant, a demulsifier, a friction modifier, an oiliness-improving agent, a rust inhibitor, and a metal deactivator.

[14]A lubricating oil composition containing:

the viscosity index improver composition according to any of the above items [1] to [12]; and a lubricating base oil.

[15]A method for producing a lubricating oil composition containing:

a step of mixing a lubricating base oil and the following poly(meth)acrylate (A) and the following poly(meth) acrylate (B), and satisfying the following requirement (1) or (2), Poly(meth)acrylate (A): containing a constituent unit (Y) derived from a monomer (y) having a diol functional group, Poly(meth)acrylate (B): containing a constituent unit (Z) derived from a monomer (z) having a boronic acid ester, Requirement (1): Both of the poly(meth)acrylate (A) and the poly(meth)acrylate (B) contain a constituent unit (X1) derived from (meth)acrylate (x1) having a linear alkyl group which has 4 or less carbon atoms in the side chain, and a constituent unit (X3) derived from (meth)acrylate (x3) having a branched alkyl group which has 24 to 38 carbon atoms in the side chain, and both of the poly(meth)acrylate (A) and the poly(meth)acrylate (B) may further contain a constituent unit (X2) derived from (meth)acrylate (x2) having a linear or branched alkyl group which has 10 to 23 carbon atoms in the side chain, Requirement (2): One of the poly(meth)acrylate (A) and the poly(meth)acrylate (B) contains a constituent unit (X1) derived from (meth)acrylate (x1) having a linear alkyl group which has 4 or less of carbon atoms in the side chain, and a constituent unit (X3) derived from (meth)acrylate (x3) having a branched alkyl group which has 24 to 38 of carbon atoms in the side chain, and at least the other of the poly (meth)acrylate (A) and the poly(meth)acrylate (B) contains a constituent unit (X2) derived from (meth) acrylate(x2) having a linear or branched alkyl group which has 10 to 23 carbon atoms in the side chain.

EXAMPLE

The present invention will be specifically described by the following Examples, but the present invention is not limited to the following Examples.

[Measurement Method of Various Physical Property Values]

The measurement of each property of each raw material used in each of Examples and Comparative Examples and the lubricating oil composition of each of Examples and Comparative Examples was performed according to the following procedure.

(1) Kinematic Viscosity, Viscosity Index

The kinematic viscosity at 100° C. and viscosity index of the base oil and the lubricating oil composition were measured or calculated according to JIS K2283:2000.

(2) Mass Average Molecular Weight (Mw), Molecular Weight Distribution (Mw/Mn)

One "TSKguardcolumn SuperHZ-L" column and two "TSKSuperMultipore HZ-M" columns manufactured by Tosoh were attached "1515 isocratic HPLC pump" and "2414 differential refractive index (RI) detector" manufactured by Waters, in this order from the upstream, and measurement was carried out under the conditions of measurement temperature: 40° C., mobile phase: tetrahydrofuran, flow rate: 0.35 mL/min, sample concentration: 1.0 mg/mL, and standard polystyrene conversion was calculated.

[Production of PMA (A), PMA (B), and PMA (C) (Comparative Example PMA)]

PMA (A), PMA (B), and PMA (C) (Comparative Example PMA) were manufactured according to Production Examples 1 to 4 and Comparative Production Example 1 described below.

In addition, in the following description and the abbreviation of each component shown in the following Table 1, each represents the following compound.

[C1MA]: Methyl Methacrylate

Methyl methacrylate is a compound in which $R^{11}$ is a methyl group, $R^{13}$ is a methyl group, and n1=0 in the above general formula (I-1). Methyl methacrylate corresponds to (meth)acrylate (x1) having a linear alkyl group having 4 or less carbon atoms in the side chain.

[C12MA]: n-Dodecyl Methacrylate n-dodecyl methacrylate is a compound represented by the above general formula (1-2), in which $R^{21}$ is a methyl group, $R^{23}$ is an n-dodecyl group, and n2=0. n-dodecyl methacrylate corresponds to (meth)acrylate (x2) having a linear or branched alkyl group having 10 to 23 carbon atoms in the side chain.

[C32MA]: 2-Tetradecyl Octadecyl Methacrylate 2-tetradecyl octadecyl methacrylate is a compound in which $R^{33}$ is an n-tetradecyl group, $R^{34}$ is an n-hexadecyl group, and n3=0, in the general formula (I-3). 2-tetradecyl octadecyl methacrylate corresponds to (meth)acrylate (x3) having a branched alkyl group having 24 to 38 carbon atoms in the side chain.

[Monomer Having a Diol Group]

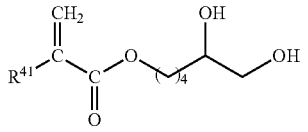

The above compound is a compound in which $R^{41}$ is a methyl group, p=4, q=0, and $R^{42}$ and $R^{43}$ are hydrogen atoms in the above general formula (II).

A monomer having a diol group was prepared by the following method (3-step process).

(First Step: Protection of Diol Group in Triol Compound)

21.1 g (157 mmol) of 1,2,6-hexanetriol was introduced into a 0.5 L flask. 2.0 g of molecular sieve (4 angstroms) was then added sequentially to 200 mL of acetone. Then, 1.0 g (5.2 mmol) of p-toluenesulfonic acid was slowly added. The reaction medium was stirred for 12 hours at ambient temperature. Then 2.0 g (23.7 mmol) of $NaHCO_3$ was added. The reaction medium was stirred for 3 hours at ambient temperature before being filtered. The filtrate was then concentrated under reduced pressure on a rotary evaporator until a suspension of white crystals was obtained. Then 200 mL of water was added to this suspension. The solution obtained in this manner was extracted three times with 200 mL of dichloromethane. The organic phases from each extraction were combined and dried using $MgSO_4$. Thereafter, the solvent was completely evaporated by a rotary evaporator at 25° C. under reduced pressure.

(Second Step: Introduction of Methacryloyl Group)

The product obtained in the first step was introduced into a 0.5 L flask topped with a dropping funnel. 500 mL of dichloromethane was introduced into the flask, and 17.9 g (182 mmol) of triethylamine was introduced in the flask. A solution in which 18.0 g (172 mmol) of methacryloyl chloride and 20 ml of dichloromethane was mixed was introduced into the dropping funnel. The flask was then placed in an ice bath to reduce the temperature of the reaction medium to around 0° C. and the methacryloyl chloride solution was added dropwise under vigorous stirring. After the addition of methacryloyl chloride was complete, the reaction medium was stirred for 1 hour at 0° C. and then for 6 hours at ambient temperature. Thereafter, the reaction medium was transferred to a 2 L Erlenmeyer flask, and 0.5 L of dichloromethane was added. The organic phase was then washed twice with 0.5M hydrochloric acid, twice with 150 mL of saturated aqueous $NaHCO_3$ solution, and twice with 150 mL of saturated brine. The organic phase was dried by $MgSO_4$, then filtered and concentrated under reduced pressure using a rotary evaporator, and 30.0 g of diol monomer protected in ketal form (78.2% yield) which is a white-yellow liquid, was produced.

The structural formula of the diol monomer protected in the ketal form is shown below.

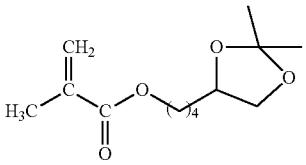

(Third Step: Deprotection)

Next, 30.0 g (124.0 mmol) of the product obtained in the second step was placed in a 1 L round bottom flask. Subsequently, 120 mL of water and 120 mL of acetonitrile were charged into the flask, followed by 30.0 mL (80.7 mmol) of acetic acid. The flask was then stirred at 35° C. for 24 hours while gently bubble conducting nitrogen gas to remove acetone from the reaction system. The solution obtained in this manner was extracted with 3×50 mL of ethyl acetate. The organic phase was washed sequentially with 3×50 mL of 0.5 M aqueous NaOH followed by 50 mL of saturated brine. Further, the organic phase was dried and filtered over $MgSO_4$ and concentrated using a rotary evaporator under vacuum to obtain 20.2 g (80.6% yield) of a pale yellow liquid.

[Boronic Ester Monomer]

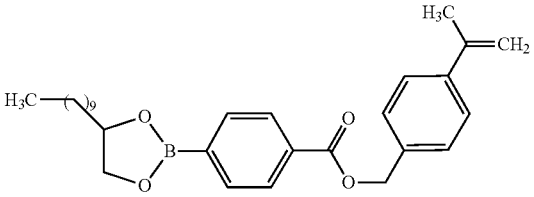

The compound is a compound in which in the above general formula (III), t=0, u=1, one of $R^{50}$ and $R^{51}$ is a hydrogen atom, the other is a linear alkyl group having 10 carbon atoms, and $R^{52}$ is a phenylene group, $R^{53}$ is a divalent group obtained by removing one hydrogen atom from a benzyl group, M is —C(O)—O—, and $R^{54}$ is a methyl group.

The boronic acid ester monomer was prepared by the following method (two-step process).

(First Step)

4-carboxyphenylboronic acid (CPBA) (5.01 g; 30.2 mmol) was introduced into a 1 L beaker, followed by 350 mL of acetone. The reaction medium was stirred and 7.90 mL (439 mmol) of water were added dropwise until the 4-carboxyphenylboronic acid was completely dissolved. Then, 1,2-propanediol (2.78 g; 36.6 mmol) was added slowly, an excess amount of magnesium sulfate was added, and the initially introduced water and the released water by condensation between CPBA and 1,2-propanediol were captured. The reaction medium was stirred for 1 hour at 25° C. before being filtered. The solvent was then removed by rotary evaporator. The obtained product and 85 mL of dimethyl sulfoxide (DMSO) were introduced into a 250 mL flask. The reaction medium was stirred and, after complete homogenization of the reaction medium, 8.33 g (60.3 mmol) of $K_2CO_3$ were added. Then, 4-chloromethylstyrene (3.34 g; 21.9 mmol) was slowly introduced into the flask. The reaction medium was then left under stirring at 50° C. for 12 hours. The reaction medium was transferred to a 2 L Erlenmeyer flask and 900 mL of water was added. The aqueous phase was extracted eight times with 150 mL of ethyl acetate. The organic phases from each extraction were mixed and then extracted three times with 250 mL of water. The organic phase was dried with $MgSO_4$ and filtered. The solvent was removed from the filtrate by rotary evaporator to produce boronic acid monomer (5.70 g; 92.2% yield) as a white powder.

(Second Step)

The boronic acid monomer (5.7 g; 20.2 mmol) obtained in the first step and 500 mL of acetone were introduced into a 1 L Erlenmeyer flask. The reaction medium was stirred and 2.6 mL (144 mmol) of water were added dropwise until boronic acid monomer was completely dissolved. A solution of 1,2-dodecanediol (5.32 g; 26.3 mmol) in 50 mL of acetone is slowly added to the reaction medium, an excess of magnesium sulfate was added, and the initially introduced water and the water released by condensation between the boronic acid monomer and 1,2-dodecanediol were captured. After stirring for 3 hours at ambient temperature, the reaction medium was filtered. Thereafter, the solvent was removed from the filtrate by a rotary evaporator to produce 10.2 g of a mixture of boronic acid ester monomer and 1,2-dodecanediol in the form of a white-yellow solid.

Production Example 1: Production of PMA (A)-1

Into a reaction vessel equipped with a stirring device, a heating/cooling device, a thermometer, and a nitrogen blowing tube, 22 g (91 mmol) of dodecyl methacrylate, 2 g (10 mmol) of a monomer having a diol group, and 24 g of 2-ethylhexyl sebacate as a solvent were charged.

Next, the inside of the reaction vessel was purged with nitrogen, and 0.1 g (0.4 mmol) of 2,2'-azobis(2,4-dimethylvaleronitrile) and 0.08 g (0.4 mmol) of n-dodecylmercaptan were added as initiators. After the addition, the temperature was slowly raised while stirring, and the reaction was carried out at a temperature of 75 to 85° C. for 6 hours. After the reaction was completed, unreacted monomers were distilled off under reduced pressure, and the PMA (A)-1 was obtained.

Production Example 2: Production of PMA (A)-2

In a reaction vessel equipped with a stirring device, a heating/cooling device, a thermometer, and a nitrogen blowing tube, 4 g (17 mmol) of dodecyl methacrylate, 2 g (10 mmol) of a monomer having a diol group, and 8 g (15 mmol) of 2-tetradecyloctadecyl methacrylate, 9 g (90 mmol) of methyl methacrylate, and 28 g of 2-ethylhexyl sebacate as a solvent were charged.

Next, the inside of the reaction vessel was purged with nitrogen, and 0.1 g (0.4 mmol) of 2,2'-azobis(2,4-dimethylvaleronitrile) and 0.08 g (0.4 mmol) of n-dodecylmercaptan were added as initiators. After the addition, the temperature was slowly raised while stirring, and the reaction was carried out at a temperature of 75 to 85° C. for 6 hours. After the reaction was completed, unreacted monomers were distilled off under reduced pressure, and the PMA (A)-2 was obtained.

Production Example 3: Production of PMA (B)-1

Into a reaction vessel equipped with a stirring device, a heating/cooling device, a thermometer, and a nitrogen blowing tube, 22 g (91 mmol) of dodecyl methacrylate, 2 g of boronic ester monomer, and 24 g of 2-ethylhexyl sebacate as a solvent were charged. Next, the inside of the reaction vessel was purged with nitrogen, and 0.1 g (0.4 mmol) of 2,2'-azobis(2,4-dimethylvaleronitrile) and 0.08 g (0.4 mmol) of n-dodecylmercaptan were added as initiators. After the addition, the temperature was slowly raised while stirring, and the reaction was carried out at a temperature of 75 to 85° C. for 6 hours. After the reaction was completed, by distilled off the unreacted monomers under reduced pressure, and the PMA(B)-1 was obtained.

Production Example 4: Production of PMA (B)-2

In a reaction vessel equipped with a stirring device, a heating/cooling device, a thermometer, and a nitrogen blowing tube, 4 g (17 mmol) of dodecyl methacrylate, 2 g of boronic acid ester, and 8 g (15 mmol) of 2-tetradecyloctadecyl methacrylate, 9 g (90 mmol) of methyl methacrylate, and 28 g of 2-ethylhexyl sebacate as a solvent were charged.

Next, the inside of the reaction vessel was purged with nitrogen, and 0.1 g (0.4 mmol) of 2,2'-azobis(2,4-dimethylvaleronitrile) and 0.08 g (0.4 mmol) of n-dodecylmercaptan were added as initiators. After the addition, the temperature was slowly raised while stirring, and the reaction was carried out at a temperature of 75 to 85° C. for 6 hours. After the reaction was completed, by distilled off the unreacted monomers under reduced pressure, and the PMA(B)-2 was obtained.

Comparative Production Example 1: Production of PMA (C)-1

In a reaction vessel equipped with a stirring device, a heating/cooling device, a thermometer, and a nitrogen blowing tube, 9 g (90 mmol) of methyl methacrylate, 11 g (21 mmol) of 2-tetradecyloctadecyl methacrylate, and as a solvent, 20 g of a hydrocarbon-based GrII base oil (40° C., KV: 7.1 mm2/s, VI: 109) were charged.

Next, the inside of the reaction vessel was purged with nitrogen, and 0.1 g (0.4 mmol) of 2,2'-azobis(2,4-dimethylvaleronitrile) and 0.08 g (0.4 mmol) of n-dodecylmercaptan were added as initiators. After the addition, the temperature was slowly raised while stirring, and the reaction was carried out at a temperature of 75 to 85° C. for 6 hours. After the reaction was completed, by distilled off the unreacted monomers under reduced pressure, and the PMA(C)-1 was obtained.

Table 1 shows the blending ratio (mass %) of each monomer in Production Examples 1 to 4 and Comparative Production Example 1, the physical properties of the polymer (number average molecular weight, mass average molecular weight, molecular weight distribution), composition of viscosity index improver composition, appearance of polymer in viscosity index improver composition at room temperature (25° C.) (results of visual observation).

TABLE 1

| | | | Production Example 1 | Production Example 2 | Production Example 3 |
|---|---|---|---|---|---|
| Polymer | | | (A)-1 | (A)-2 | (B)-1 |
| Monomer | (x1) | C1MA | 0 | 39 | 0 |
| (mass %) | (x2) | C12MA | 92 | 17 | 92 |
| *1 | (x3) | C32MA | 0 | 35 | 0 |
| | (y) | Monomer having a diol group | 8 | 9 | 0 |
| | (z) | Monomer having boronic acid ester | 0 | 0 | 8 |
| Total amount of monomer (mass %) | | | 100 | 100 | 100 |
| Monomer | (x1) | C1MA | 0 | 68 | 0 |
| (mol %) | (x2) | C12MA | 91 | 12 | 94 |
| *2 | (x3) | C32MA | 0 | 12 | 0 |
| | (y) | Monomer having a diol group | 9 | 8 | 0 |
| | (z) | Monomer having boronic acid ester | 0 | 0 | 6 |
| Total amount of monomers (mol %) | | | 100 | 100 | 100 |
| Physical properties of polymer | Number average molecular weight Mn | | 32000 | 36000 | 19000 |
| | Mass average molecular weight Mw | | 44000 | 48000 | 31000 |
| | Molecular weight distribution Mw/Mn | | 1.4 | 1.3 | 1.6 |
| Viscosity index | Viscosity index improver composition | | A1 | A2 | B1 |
| | Polymer | | 50 | 50 | 50 |

TABLE 1-continued

| | | | | | |
|---|---|---|---|---|---|
| improver composition (mass %) *3 | Polymerization diluent *4 | | 50 | 50 | 50 |
| | Polymer appearance (25° C.) | | Colorless and transparent | Colorless and transparent | Colorless and transparent |

| | | | Production Example 4 | Comparative Production Example 1 |
|---|---|---|---|---|
| Polymer | | | (B)-2 | (C)-1 |
| Monomer (mass %) *1 | (x1) | C1MA | 39 | 47 |
| | (x2) | C12MA | 17 | 0 |
| | (x3) | C32MA | 35 | 53 |
| | (y) | Monomer having a diol group | 0 | 0 |
| | (z) | Monomer having boronic acid ester | 9 | 0 |
| Total amount of monomer (mass %) | | | 100 | 100 |
| Monomer (mol %) *2 | (x1) | C1MA | 71 | 83 |
| | (x2) | C12MA | 12 | 0 |
| | (x3) | C32MA | 12 | 17 |
| | (y) | Monomer having a diol group | 0 | 0 |
| | (z) | Monomer having boronic acid ester | 5 | 0 |
| Total amount of monomers (mol %) | | | 100 | 100 |
| Physical properties of polymer | Number average molecular weight Mn | | 20000 | 28000 |
| | Mass average molecular weight Mw | | 32000 | 41000 |
| | Molecular weight distribution Mw/Mn | | 1.6 | 1.5 |
| Viscosity index improver composition (mass %) *3 | Viscosity index improver composition | | B2 | C1 |
| | Polymer | | 50 | 50 |
| | Polymerization diluent *4 | | 50 | 50 |
| | Polymer appearance (25° C.) | | Colorless and transparent | Colorless and transparent |

*1: Content of each monomer in 100 mass % of total monomers (mass %)
*2: Content of each monomer in 100 mol % of total monomers (mol %)
*3: Content of each component in 100 mass % of the total viscosity index improver composition (mass %)
*4: Production example: Sebacic acid (2-ethylhexyl)

Examples 1 to 3, Comparative Examples 1 to 6

The lubricating base oil (mineral oil) and each viscosity index improver composition produced in Production Examples 1 to 4 and Comparative Production Example 1 were blended in the proportions shown in Table 2 and mixed thoroughly, and the lubricating oil compositions of Comparative Examples 1 to 3 and Comparative Examples 1 to 6 were respectively prepared.

The blending ratios shown in Table 2 were adjusted so that the lubricating oil composition had a kinematic viscosity of 7 $mm^2/s$ at 100° C.

The mineral oil having a 100° C. kinematic viscosity of 4.2 $mm^2/s$, a viscosity index of 122, and an API classification of Group II, was used.

The results are shown in Table 2. The amount of the viscosity index improver composition in Table 2 is the amount including the polymerization diluent.

TABLE 2

| | | | Example 1 | Example 2 | Example 3 | Comparative Example 1 | Comparative Example 2 |
|---|---|---|---|---|---|---|---|
| Lubricating oil composition (mass %) | Lubricating base oil (Mineral oil) | | 89.9 | 88.8 | 89.5 | 91.5 | 78 |
| | Viscosity index improver composition | A1 | 6.3 | — | — | 5.3 | — |
| | | A2 | — | 7 | 6.6 | — | — |
| | | B1 | — | 4.2 | — | 3.2 | — |
| | | B2 | 3.8 | — | 3.9 | — | — |
| | | C1 | — | — | — | — | 22 |
| Total | | | 100 | 100 | 100 | 100 | 100 |
| Kinematic viscosity at 40° C. ($mm^2/s$) | | | 28.4 | 27.4 | 25.6 | 28.5 | 29.4 |
| Kinematic viscosity at 100° C. ($mm^2/s$) *1 | | | 7 | 7 | 7 | 7 | 7 |
| Viscosity index | | | 224 | 236 | 258 | 222 | 213 |

TABLE 2-continued

| | | | Comparative example 3 | Comparative Example 4 | Comparative Example 5 | Comparative Example 6 |
|---|---|---|---|---|---|---|
| Lubricating oil composition (mass %) | Lubricating base oil (Mineral oil) | | 87.4 | 86.4 | 84.8 | 80.6 |
| | Viscosity index improver composition | A1 | 12.6 | — | — | — |
| | | A2 | — | 13.6 | — | — |
| | | B1 | — | — | 15.2 | — |
| | | B2 | — | — | — | 19.4 |
| | | C1 | — | — | — | — |
| Total | | | 100 | 100 | 100 | 100 |
| Kinematic viscosity at 40° C. ($mm^2/s$) | | | 31.3 | 29.6 | 31.6 | 30.5 |
| Kinematic viscosity at 100° C. ($mm^2/s$) *1 | | | 7 | 7 | 7 | 7 |
| Viscosity index | | | 195 | 212 | 193 | 203 |

*1: Evaluated at 7 $mm^2/s$ of kinematic viscosity at 100° C.

From Table 2, the following can be found.

It can be found that the lubricating oil compositions of Examples 1 to 3 have higher viscosity indexes than the lubricating oil compositions of Comparative Examples 1 to 6.

Therefore, from the results shown in Table 2, it can be found that the effect of improving the viscosity index is achieved by one or both of PMA (A) and PMA (B) further containing a constituent unit (X1) derived from (meth) acrylate (x1) having a linear alkyl group which has 4 or less carbon atoms in the side chain and a constituent unit (X3) derived from (meth)acrylate (x3) having a branched alkyl group which has 24 to 38 carbon atoms in the side chain.

Examples 4 to 6, Comparative Examples 7 to 12

The lubricating base oil (ester oil) and each viscosity index improver composition produced in Production Examples 1 to 4 and Comparative Production Example 1 were blended in the proportions shown in Table 3 and mixed thoroughly, and the lubricating oil compositions of Examples 4 to 6 and Comparative Examples 7 to 12 were respectively prepared.

As the ester oil, sebacic acid (2-ethylhexyl) (100° C. kinematic viscosity: 3.2 $mm^2/s$, viscosity index: 153) was used.

The results are shown in Table 3. The amount of the viscosity index improver composition in Table 3 is the amount including the polymerization diluent.

TABLE 3

| | | | Example 4 | Example 5 | Example 6 | Comparative Example 7 | Comparative Example 8 |
|---|---|---|---|---|---|---|---|
| Lubricating oil composition (mass %) *1 | Lubricating base oil (Ester oil) | | 84 | 84 | 84 | 84 | 84 |
| | Viscosity index improver composition | A1 | 8 | — | — | 8 | — |
| | | A2 | — | 8 | 8 | — | — |
| | | B1 | — | 8 | — | 8 | — |
| | | B2 | 8 | — | 8 | — | — |
| | | C1 | — | — | — | — | 16 |
| Total | | | 100 | 100 | 100 | 100 | 100 |
| Kinematic viscosity at 40° C. ($mm^2/s$) | | | 38.3 | 43.1 | 42.2 | 31.5 | 28.8 |
| Kincmatic viscosity at 100° C. ($mm^2/s$) | | | 12.1 | 14.6 | 13.9 | 8.8 | 7.3 |
| Viscosity index | | | 292 | 354 | 344 | 278 | 238 |

| | | | Comparative example 9 | Comparative Example 10 | Comparative Example 11 | Comparativc Example 12 |
|---|---|---|---|---|---|---|
| Lubricating oil composition (mass %) *1 | Lubricating base oil (Ester oil) | | 84 | 84 | 84 | 84 |
| | Viscosity index improver composition | A1 | 16 | — | — | — |
| | | A2 | — | 16 | — | — |
| | | B1 | — | — | 16 | — |
| | | B2 | — | — | — | 16 |
| | | C1 | — | — | — | — |
| Total | | | 100 | 100 | 100 | 100 |

TABLE 3-continued

| | | | | |
|---|---|---|---|---|
| Kinematic viscosity at 40° C. ($mm^2/s$) | 22.5 | 29.5 | 23.3 | 24.9 |
| Kinematic viscosity at 100° C. ($mm^2/s$) | 6.0 | 8.0 | 6.2 | 6.6 |
| Viscosity index | 236 | 264 | 235 | 240 |

*1: Evaluated with addition of 16 mass %

From Table 3, the following can be found.

It can be found that the lubricating oil compositions of Examples 4 to 6 have higher viscosity indexes than the lubricating oil compositions of Comparative Examples 7 to 12.

Therefore, from the results shown in Table 3, it can be found that the effect of improving the viscosity index is achieved by one or both of PMA (A) and PMA (B) further containing a constituent unit (X1) derived from (meth) acrylate (x1) having a linear alkyl group which has 4 or less carbon atoms in the side chain and a constituent unit (X3) derived from (meth)acrylate (x3) having a branched alkyl group which has 24 to 38 carbon atoms in the side chain.

The invention claimed is:

1. A viscosity index improver composition, comprising:

a poly(meth)acrylate (A) comprising a constituent unit (Y) derived from a monomer (y) having a diol functional group; and a poly(meth)acrylate (B) comprising a constituent unit (Z) derived from a monomer (z) having a boronic acid ester, wherein both the poly(meth)acrylate (A) and the poly (meth)acrylate (B) further comprise a constituent unit (X1) derived from a (meth)acrylate (x1) having a linear alkyl group which has 4 or less carbon atoms in the side chain, and a constituent unit (X3) derived from (meth) acrylate (x3) having a branched alkyl group which has 24 to 38 carbon atoms in the side chain, or wherein one of the poly(meth)acrylate (A) and the poly (meth)acrylate (B) further comprises the constituent unit (X1) and the constituent unit (X3), and at least the other of the poly(meth)acrylate (A) and the poly(meth) acrylate (B) further comprises a constituent unit (X2) derived from (meth)acrylate (x2) having a linear or branched alkyl group which has 10 to 23 carbon atoms in the side chain.

2. The viscosity index improver composition of claim 1, wherein the poly(meth)acrylate (A) has a mass average molecular weight (Mw) in a range of from 10,000 to 70,000.

3. The viscosity index improver composition of claim 1, wherein the poly(meth)acrylate (B) has a mass average molecular weight (Mw) in a range of from 10,000 to 70,000.

4. The viscosity index improver composition of claim 1, wherein, the poly(meth)acrylate (A) comprises the constituent unit (X1) and the constituent unit (X3), and wherein a total content of the constituent unit (X1) and the constituent unit (X3) in the poly(meth)acrylate (A) is 50 mass % or more, based on all constituent units of the poly(meth)acrylate (A).

5. The viscosity index improver composition of claim 1, wherein the poly(meth)acrylate (A) comprises the constituent unit (X1) and the constituent unit (X3), and wherein an (X1)/(X3) mass ratio of the constituent unit (X1) and the constituent unit (X3) in the poly(meth) acrylate (A) is in a range of from 1/5 to 5/1.

6. The viscosity index improver composition of claim 1, wherein the poly(meth)acrylate (B) comprises the constituent unit (X1) and the constituent unit (X3), and wherein a total content of the constituent unit (X1) and the constituent unit (X3) in the poly(meth)acrylate (B) is 50 mass % or more, based on all constituent units of the poly(meth)acrylate (B).

7. The viscosity index improver composition of claim 1, wherein the poly(meth)acrylate (B) comprises the constituent unit (X1) and the constituent unit (X3), and wherein an (X1)/(X3) mass content ratio of the constituent unit (X1) and the constituent unit (X3) in the poly(meth)acrylate (B) is in a range of from 1/5 to 5/1.

8. The viscosity index improver composition of claim 1, wherein the poly(meth)acrylate (A) and the poly(meth) acrylate (B) comprise the constituent unit (X1), and the constituent unit (X3).

9. The viscosity index improver composition of claim 1, wherein the linear alkyl group in the (meth)acrylate (x1) is a methyl group.

10. The viscosity index improver composition of claim 1, wherein the (meth)acrylate (x3) is a compound of formula (I-3):

(I-3)

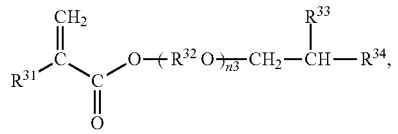

wherein $R^{31}$ is a hydrogen atom or a methyl group, $R^{32}$ is a linear or branched alkylene group having 2 to 4 carbon atoms, $R^{33}$ and $R^{34}$ are each independently a linear or branched alkyl group having a total carbon number of 22 to 26 carbon atoms, a total carbon number of alkyl groups in $R^{33}$ and $R^{34}$ being in a range of from 22 to 36, and n3 is an integer in a range of from 0 to 20, wherein, when n3 is 2 or more, a plurality of $R^{32}$'s are the same or different.

11. The viscosity index improver composition of claim 1, wherein the monomer (y) has formula (II):

(II)

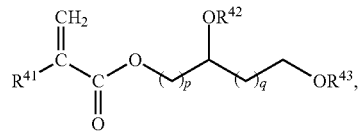

wherein $R^{41}$ is a hydrogen atom or a methyl group, p is an integer in a range of from 2 to 18, q is 0 or 1, and $R^{42}$ and $R^{43}$ are each independently a hydrogen atom, a tetrahydropyranyl group, a methyloxymethyl group, a tert-butyl group, a benzyl group, a trimethylsilyl group, or a tert-butyldimethylsilyl group, or $R^{42}$ and $R^{43}$ form a bridge of formula (IIa) with an oxygen atom:

(IIa)

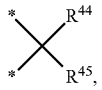

wherein

* is a bonding position with the oxygen atom, and $R^{44}$ and $R^{45}$ are each independently a hydrogen atom or an alkyl group having 1 to 11 carbon atoms, or $R^{42}$ and $R^{43}$ form a boronic acid ester of formula (IIb) with an oxygen atom:

(IIb)

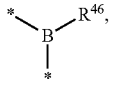

wherein

* is a bonding position with the oxygen atom, and $R^{46}$ is an aryl group having 6 to 18 carbon atoms, an aralkyl group having 7 to 18 carbon atoms, or an alkyl group having 2 to 18 carbon atoms.

12. The viscosity index improver composition of claim 1, wherein the monomer (z) has formula (III):

(III)

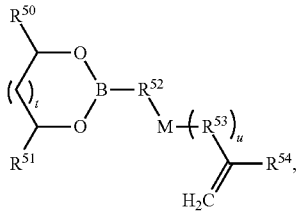

wherein t is 0 or 1, u is 0 or 1, $R^{50}$ and $R^{51}$ are each independently a hydrogen atom or a hydrocarbon-comprising chain having 1 to 24 carbon atoms, $R^{32}$ and $R^{53}$ are each independently an arylene group having 6 to 18 carbon atoms, an aralkylene group having 7 to 24 carbon atoms, and an alkylene group having 2 to 24 carbon atoms, M is —O—C(O)—, —C(O)—O—, —C(O)—N(H)—, —N(H)—C(O)—, —S—, —N(H)—, —N($R^a$)—, or —O—, $R^a$ being a hydrocarbon-comprising chain having 1 to 15 carbon atoms, and $R^{54}$ is a hydrogen atom or a methyl group.

13. An additive composition, comprising:

the viscosity index improver composition of claim 1; and a metallic detergent, an abrasion resistant agent, an ash-free dispersant, an extreme pressure agent, a pour point depressant, an antioxidant, an anti-foaming agent, a surfactant, a demulsifier, a friction modifier, an oiliness-improving agent, a rust inhibitor, and/or a metal deactivator.

14. A lubricating oil composition, comprising:

the viscosity index improver composition of claim 1; and a lubricating base oil.

15. A method for producing a lubricating oil composition with the viscosity index improver composition of claim 1, the method comprising:

mixing a lubricating base oil, the poly(meth)acrylate (A), and the poly(meth)acrylate (B).

16. The viscosity index improver composition of claim 1, wherein both the poly(meth)acrylate (A) and the poly(meth) acrylate (B) further comprise the constituent unit (X1), the constituent unit (X3), and the constituent unit (X2).

17. The viscosity index improver composition of claim 1, wherein the poly(meth)acrylate (A) comprises the constituent unit (Y), the constituent unit (X1), and the constituent unit (X3), and wherein the poly(meth)acrylate (B) comprises the constituent unit (Z) and the constituent unit (X2).

18. The viscosity index improver composition of claim 1, wherein the poly(meth)acrylate (A) comprises the constituent unit (Y), the constituent unit (X1), the constituent unit (X2), and the constituent unit (X3), and wherein the poly(meth)acrylate (B) comprises the constituent unit (Z) and the constituent unit (X2).

19. The viscosity index improver composition of claim 1, wherein the poly(meth)acrylate (A) comprises the constituent unit (Y) and the constituent unit (X2), and wherein the poly(meth)acrylate (B) comprises the constituent unit (Z), the constituent unit (X1), and the constituent unit (X3).

20. The viscosity index improver composition of claim 1, wherein the poly(meth)acrylate (A) comprises the constituent unit (Y) and the constituent unit (X2), and wherein the poly(meth)acrylate (B) comprises the constituent unit (Z), the constituent unit (X1), the constituent unit (X2), and the constituent unit (X3).

* * * * *